US011634897B2

(12) United States Patent
Watkins, Jr. et al.

(10) Patent No.: US 11,634,897 B2
(45) Date of Patent: Apr. 25, 2023

(54) INTEGRATED AIRGAP RETROFIT BODY

(71) Applicant: Polecat Innovations, LLC, Minneapolis, MN (US)

(72) Inventors: James David Watkins, Jr., Minneapolis, MN (US); Casimir A Sienkiewicz, Minneapolis, MN (US)

(73) Assignee: POLECAT INNOVATIONS, LLC, Minneapolis, MN (US)

( * ) Notice: Subject to any disclaimer, the term of this patent is extended or adjusted under 35 U.S.C. 154(b) by 34 days.

(21) Appl. No.: 17/395,246

(22) Filed: Aug. 5, 2021

(65) Prior Publication Data

US 2022/0145604 A1 May 12, 2022

Related U.S. Application Data

(63) Continuation-in-part of application No. 17/093,545, filed on Nov. 9, 2020, now abandoned.

(51) Int. Cl.
*E03C 1/10* (2006.01)

(52) U.S. Cl.
CPC ..... *E03C 1/102* (2013.01)

(58) Field of Classification Search
CPC ..... E03C 1/102
USPC ..... 4/678
See application file for complete search history.

(56) References Cited

U.S. PATENT DOCUMENTS

| | | | | |
|---|---|---|---|---|
| 4,856,121 | A | 8/1989 | Traylor | |
| 4,967,784 | A | 11/1990 | Barhydt, Sr. et al. | |
| 4,998,555 | A | 3/1991 | Barhydt, Sr. et al. | |
| 5,176,165 | A * | 1/1993 | Traylor | E03C 1/12 137/515 |
| 5,865,209 | A * | 2/1999 | Vidal | E03C 1/102 210/441 |
| 7,011,106 | B2 * | 3/2006 | Kawolics | E03C 1/102 137/216 |
| 2006/0076056 | A1 | 4/2006 | Schmitt et al. | |
| 2006/0157109 | A1 * | 7/2006 | Vu | E03C 1/0401 137/216 |
| 2019/0134849 | A1 | 5/2019 | Rosko et al. | |

* cited by examiner

*Primary Examiner* — Huyen D Le
(74) *Attorney, Agent, or Firm* — Grumbles Law PLLC; Bryan Kravis

(57) ABSTRACT

A retrofit body for a faucet that provides an airgap vent is disclosed. The retrofit body may work with any faucet where the faucet body projects through a countertop. The airgap vent is in fluid communication with a drainpipe and a wastewater stream from an appliance.

7 Claims, 20 Drawing Sheets

INTEGRATED AIRGAP RETROFIT BODY

CROSS-REFERENCE TO RELATED APPLICATION

This application is a continuation-in-part of U.S. Non-Provisional application Ser. No. 17/093,545, filed Nov. 9, 2020 and titled INTEGRATED AIRGAP APPARATUS, which is herein incorporated by reference in its entirety.

FIELD

This disclosure relates an apparatus that can be used to connect appliances to drains and can include an airgap integrated into the apparatus.

BACKGROUND

Most household appliances that are used to clean household items require water for operation. For example, most households have appliances such as washing machines and dishwashers for cleaning, for example, clothes, blankets, sheets, dishes, utensils, and cooking pots and pans. Additionally, some households can include small dishwashers that can wash, for example, wine glasses, beer mugs, and other small drinking containers.

Such household appliances typically input water, wash or rinse the household items placed therewithin, and eventually pump the wastewater out of the appliance into a drainpipe. During the draining process backflow of contaminated water can re-enter the appliance from the drain via backflow. When household items are run through such an appliance the last thing that a user wants is for those items to emerge streaked with grime pumped in from, for example, a clogged garbage disposal. It is customary, and in many locations required, to use an air gap (or airgap) in the drain line to entirely separate the drain line running dirty water from the appliance from the line running to the drain. Since, in this case, these two paths don't intersect there is no risk of wastewater creeping back into the clean appliance.

SUMMARY

The installation of appliances that require water and water disposal, for example dishwashers or water softeners that fit under a sink, may require the addition of one or more vents in their drain lines that can include air gaps to prevent backflow from the sewer or disposal when the water drains out of them. Sinks, such as kitchen sinks, typically, can have two or three holes—a central hole and one or two lateral holes—available for installation of plumbing accessories. The central hole is usually used for installation of a faucet. One or more of the lateral holes can be used for the installation of one or more accessories such as a soap dispenser, a hot water tap, a water softener, or a garbage disposal button. Typically, airgaps need to be installed above the sink to prevent contaminated water from re-entering the dishwasher or under the counter water softeners. If the sink has two accessories and one faucet already occupying the holes in the sink, there is usually no available hole for installation of an air gap for an installed appliance.

Airgap vents, such as those used, and in some locations required, for installation of appliances that have a drain, are typically mounted about two inches above the sink. They prevent contaminated water from re-entering that appliance from the drain via backflow. The air gap vent typically is installed so that it juts up above the countertop. It would be desirable to be able to attach the drain hoses or pipes from a dishwasher or water softener located below the countertop without having to drill additional holes into the countertop. Additionally, it would be desirable to be able to attach two or more of these appliances without having to drill additional holes and have additional vents projecting above the plane of the rim of the sink or the countertop.

In one aspect, an integrated airgap apparatus is disclosed that can include a sink fixture, wherein the sink fixture includes a cavity. The integrated airgap apparatus can have an airgap vent integrated into the cavity where the airgap vent can be in fluid communication with a drainpipe and a wastewater stream from an appliance. The disclosed apparatus can also include a baseplate. The sink fixture can extend through the baseplate. The sink fixture can include a faucet body, a faucet valve handle, a soap dispenser, a hot water tap, a water filtration unit, a water softener unit or an electronic button. The integrated airgap fixture can also include a retrofit body. In some embodiments, the appliance can include a dishwasher, a washing machine, or a water filtration system.

In another aspect, a faucet for a sink is disclosed that can include a faucet base. The faucet base can include a baseplate. The provided faucet for a sink can also include a faucet body projecting through the baseplate and can have a spout for delivering water that is in fluid communication with the faucet body. The provided faucet for a sink can also include at least one valve. The valve can include at least one handle that is in fluid communication with the faucet body. Finally, the provided faucet for a sink can include an air gap vent integrated into at least one of the faucet body or the at least one valve. In some embodiments, the at least one valve can project through the baseplate. The baseplate can include two or more sections. In some embodiments, the faucet body can protrude through one section of the baseplate and the at least one valve can protrude through another section of the baseplate. The two or more sections of the baseplate can be separated in space. The airgap vent can be in fluid communication with a wastewater stream from an appliance and can also be in fluid communication with an appliance. In some embodiments, the appliance can be one or more of a dishwasher, a washing machine, or a water filtration system. In some embodiments, the airgap vent can be at least partially inside of the faucet body. The airgap vent inside of the faucet body can extend above the baseplate. In some embodiments, the faucet the at least one valve can be integrated into a separate handle base.

In yet another aspect, a retrofit body is disclosed. The disclosed retrofit body includes a hollow cavity substantially cylindrical in shape having a diameter and having a fixture conduit at one end and an airgap vent conduit at an opposing end. The hollow cavity includes an axially symmetrical portion structured and configured to contain an airgap vent. The disclosed retrofit body also includes a tapered portion contiguous with one end of the axially symmetrical portion. The tapered portion can reduce the diameter of the hollow cavity and can be in communication with a fixture cavity conduit. The fixture cavity conduit can extend towards the inside of the hollow cavity. The disclosed retrofit body also includes an interior flange contiguous with the end of the fixture cavity conduit. The interior flange extends away from the interior of the fixture cavity conduit. The disclosed retrofit body also includes an airgap conduit opposite the fixture cavity conduit structured and configured to allow an airgap vent to be inserted therethrough.

As used herein:

"conduit" refers to a fluid communication pathway that can connect two or more elements and can include, for example, pipes and hoses;

"fixture" refers to any object that be part of a sink and can refer to faucet bodies, faucet valve handles, soap dispensers, hot water taps, water filtration units, water softening units electronic buttons and the like;

"fluid communication" refers two objects that are positioned or connected so that a fluid, for example, water, can travel from one object to another in a conduit such as a hose or pipe;

"retrofit body" refers to a fixture that is hollow and allows integration with an airgap vent;

"sections" refer to either parts of an article that have features separated by a distance or two different articles separated by a distance.

The above summary is not intended to describe each disclosed embodiment of every implementation of the present disclosure. The brief description of the drawings and the detailed description which follow more particularly exemplifies illustrative embodiments.

BRIEF DESCRIPTION OF THE DRAWINGS

FIG. 1A is a side planar view of the insides of the airgap vent.

DETAILED DESCRIPTION

Figure 1:
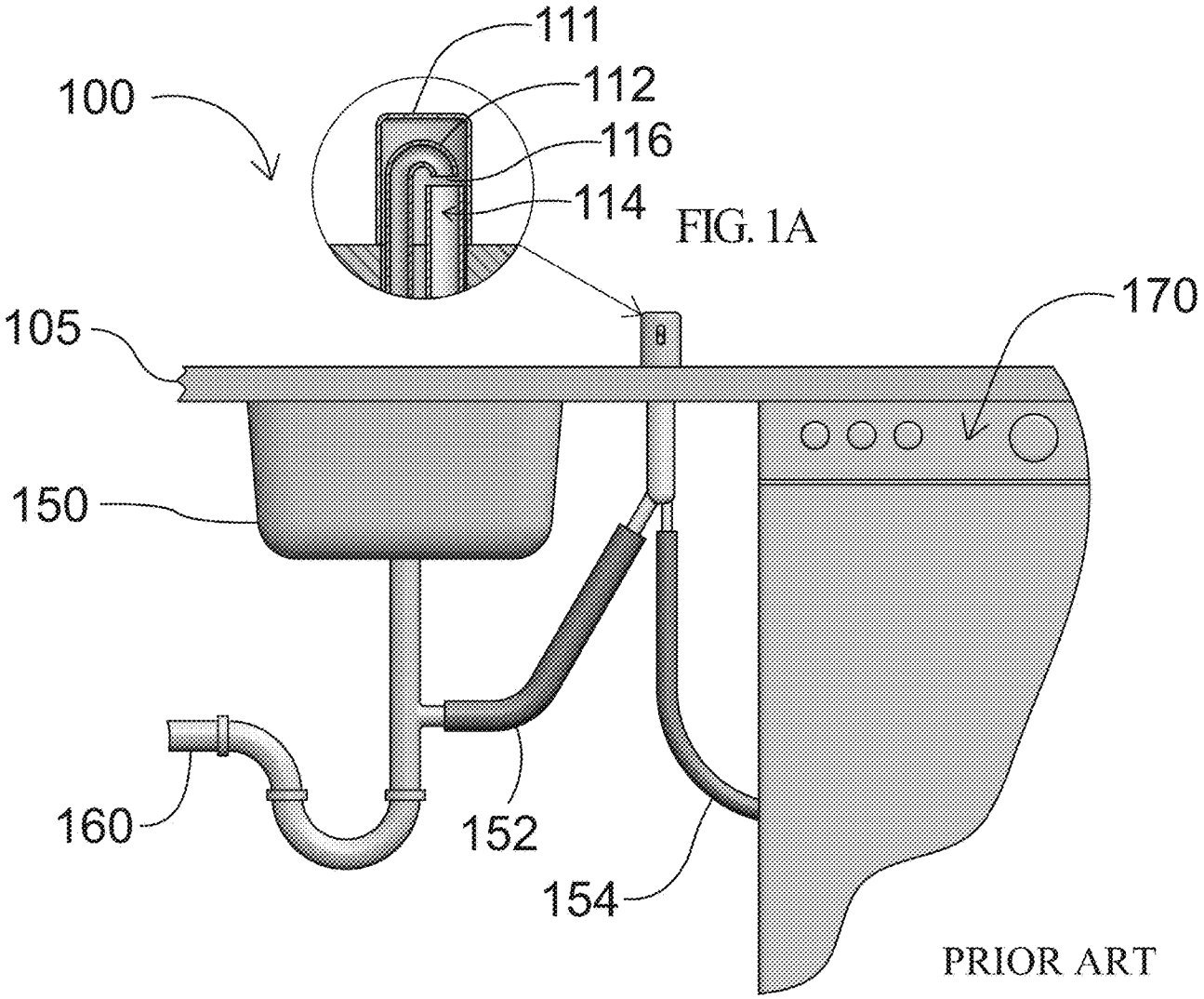
FIG. 1 is a side view of an installation of an airgap vent for a dishwasher.

In the following description, reference is made to the accompanying set of drawings that form a part of the description hereof and in which are shown by way of illustration several specific embodiments. It is to be understood that other embodiments are contemplated and may be made without departing from the scope or sprit of the present disclosure. The following detailed description, therefore, is not to be taken in a limiting sense.

In one aspect, an integrated airgap apparatus is disclosed. The integrated airgap apparatus can include a sink fixture. In this disclosure a sink can be an article that can hold or contain fluids such as water and typically can include fluid inputs devices and drains. Sinks of this disclosure can include kitchen sinks, bathroom sinks, utility sinks, or any basin structured and configured to hold water. Fluid input devices can include faucets for input of hot water, such as a hot water tap, cold water, or water of mixed temperatures, pump dispensers that dispense, for example, liquid soap or detergent.

In some embodiments, the sink fixture can include a faucet valve or handle of a faucet valve, or a retrofit body. In some embodiments, the sink fixture can include a cavity. A cavity is an empty space within the sink fixture. Integrated airgap apparatuses of this disclosure can include an airgap vent integrated into the cavity. By integrated into the cavity it is meant that the bulk of the airgap vent can be contained within the cavity. The bulk of the airgap vent an include a wastewater input conduit, a gap, and an output conduit. The wastewater input conduit can be in fluid communication with an appliance wastewater conduit. In some embodiments, appliance wastewater conduits come from an appliance such as a dishwasher, a washing machine, or a water filtration system. The output conduit of the airgap vent can be in fluid communication with a drainpipe. The bulk of the airgap vent may include some or all of the wastewater input conduit or the output conduit of the airgap vent. In some embodiments, the majority of the wastewater input conduit or the output conduit of the airgap vent can be outside of the airgap conduit can project beneath the sink fixture. In some embodiments, the sink fixture can include a button for operating, for example, a disposal, or other electrical device.

In some embodiments, the disclosed integrated airgap apparatus can include a baseplate. Disclosed baseplates are described below. The sink fixture can project through the baseplate. In some embodiments, the baseplate can have more than one section, each section having a sink fixture protruding therethrough. In these embodiments, at least one of the sink fixtures may have a cavity therewithin. In some embodiments, the sink fixture can include a faucet body which can include a spout.

In another aspect, a faucet for a sink is disclosed and can include a baseplate. The baseplate can be decorative and can cover the edges of any holes that can project through a countertop. Additionally, the baseplate can protect the edges of the holes from chipping, cracking, or eroding. The disclosed faucet can include a faucet body that can project through the baseplate and through any countertop or sink rim to which the baseplate can be secured. The faucet body can be supplied with hot, cold, or mixed temperature water through conduits which also project through the baseplate and a countertop or sink rim.

The sink can be a kitchen sink, a bathroom sink, a utility sink, or any basin structured and configured to hold water. The sink can include at least one drain hole, typically, at its lowest point to drain any water in the sink, when desired. Sinks according to the present disclosure can include a rim which can include one or more holes through the rim. The holes can be used for attachment of a faucet, one or more faucet valves, a soap dispenser, a hot water tap, a water filtration unit, a sprayer, or any other accessory useful or desirable in the disclosed sink.

The disclosed faucet for a sink can include a spout for delivering water that is in fluid communication with the faucet body. The spout can be of any shape. Spouts are fluidly connected to faucet output conduits (containing cold water, hot water, mixed temperature water) which are in turn in fluid communication with the faucet body. Typically spouts redirect the flow of water from the faucet output conduit. They can have a variety of shapes such as an arc (usually 180 degrees from the output conduit), a gentle U-shaped curve, sharp cornered U shapes, or any other shape. Sometimes a sprayer which may have several water distribution patterns can be attached to the end of the spout.

The disclosed faucet for a sink can also include at least one handle base. The handle base can include one handle that can be in mechanical communication with at least one valve. The at least one valve can be in fluid communication with the spout. In some embodiments, the disclosed faucet for a sink can include two water inputs, typically hot water and cold water. The two water inputs can be in fluid communication with the at least one valve which can, in some embodiments, mix the amount of hot water and cold water producing one tempered (mix of hot water and cold water) output which can be output to the spout. In other embodiments, the at least two water inputs can be in fluid communication with two valves that are in mechanical communication with two handles, respectively. The two valves can then be input into a faucet body. The faucet body can include a mixer to allow the hot water from one valve and the cold water from the second valve to intermix and be output to the spout.

The disclosed faucet for a sink can also include an airgap vent integrated into at least into the faucet body or the handle base. The airgap vent can be in fluid communication with a wastewater stream from an appliance. Typically, the wastewater stream from an appliance come from a wastewater output conduit in fluid communication with the appliance. The disclosed airgap vent can include a wastewater input conduit that inputs wastewater output from the appliance output conduit. The disclosed airgap vent also can include an output conduit that is in fluid communication with a drain or drainpipe. Typically, the wastewater input conduit has a bend in it (usually about 180 degrees) so that it passes through an air gap and then into the output conduit. In many embodiments, the disclosed airgap vent is enclosed in a cover. Additionally, the airgap vent is usually located at least two inches above the location on the appliance where the wastewater output conduit connects with the appliance.

In the embodiments described herein, the airgap vent is integrated into at least into the faucet body or the handle base. In this way, the airgap vent does not project above a countertop or sink rim but rather is hidden within a cavity inside of the faucet body or the handle base. An additional advantage of an integrated airgap vent in the disclosed faucet for a sink is that it does not take up an additional hole that might need to be drilled into a countertop or sink rim to accommodate the airgap vent. This might be important during an initial installation where the hole is drilled after installation and can potentially damage the countertop—particularly if the countertop is ceramic, granite, or another very brittle material. It may also be important during a retrofit installation of an airgap vent into an already installed appliance and sink. Typically, in a sink configuration that includes two or more valves, the airgap vent can be integrated into one of the valves. In some embodiments, the faucet body can include a valve body and the airgap can be integrated into the valve or valve body.

In some embodiments, the disclosed faucet for a sink, the faucet body can project through and extend above the baseplate. In other embodiments, the baseplate can include two or more sections. For example, one section of the baseplate can have the faucet body projecting through it and another section of the baseplate can have one or more valves projecting through it. In some embodiments, the spout can be a part of the faucet body or can be one continuous part.

The disclosed airgap vent can be in fluid communication with the wastewater output conduit of an appliance. Typical appliances that are connected to an airgap vent can include appliances that require water, for example, for cleaning, and that output wastewater ultimately to a drain or drainpipe. Such appliances include, for example, dishwashers, ice makers, water softening systems, water filtration systems or washing machines.

This disclosure can be further understood by reference to the accompanying figures. The figures are presented so that like parts have similar numbers for ease of interpretation.

FIG. 1 is a side view that shows a typical installation of an airgap vent for a dishwasher. FIG. 1 is prior art in that it shows an installed airgap vent as is recommended or required when connecting an appliance, such as, for example, a dishwasher, washing machine, or a water purification unit, to drainpipe 160. Installation 100 shows sink 150 installed in countertop 105. Airgap vent (not visible in FIG. 1 but visible in FIG. 1A) in this installation is shown mounted above the plane of countertop 105 to prevent backup of wastewater from drainpipe 160. Appliance 170 (a dishwasher in this embodied installation) is in fluid communication with airgap vent 110 through appliance output hose 154 that sends wastewater from appliance through airgap 100 and into drainpipe 160 through airgap output conduit 152. In some embodiments of illustrated installation 100, appliance output conduit 154 can directly connect to airgap vent 110 which in turn empties into drainpipe 160 via airgap vent output conduit 152. In some embodiment, a Y-junction can bypass the airgap vent. FIG. 1A is a side view of the inside of airgap vent 110. Airgap vent 110 includes appliance wastewater input conduit 112 (that is in fluid communication with appliance output conduit 154), airgap 116, and output conduit to drain 114.

Figure 2:
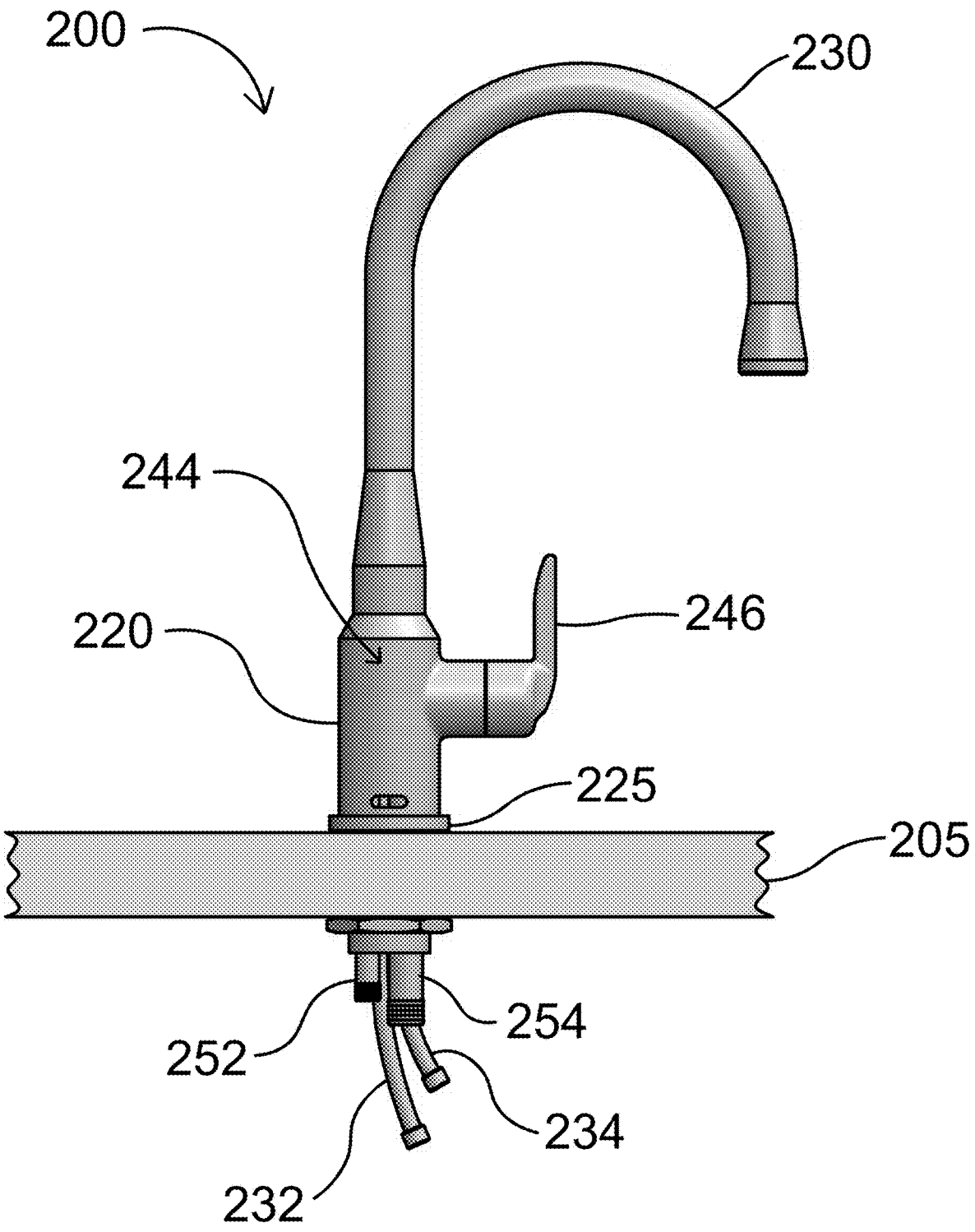
FIG. 2 is a side view of a typical sink faucet.

FIG. 2 is a side view of a typical sink faucet that is not connected to an appliance and does not include an airgap vent. It is for reference only. Sink faucet 200 includes faucet body 220 that projects through baseplate 225 and countertop 205 where it is secured by a retaining nut. Faucet body 220 is in fluid communication with spout 230 which delivers water to a sink. Handle 246 connects to a valve (not shown) that is inside of handle base 244. In this embodiment, faucet body 220 and handle base 244 are one and the same. Hot water input conduit 232 and cold-water input conduit 234 project from the bottom of faucet body 220 and supply hot water and cold water respectively to spout 230.

Figure 3:
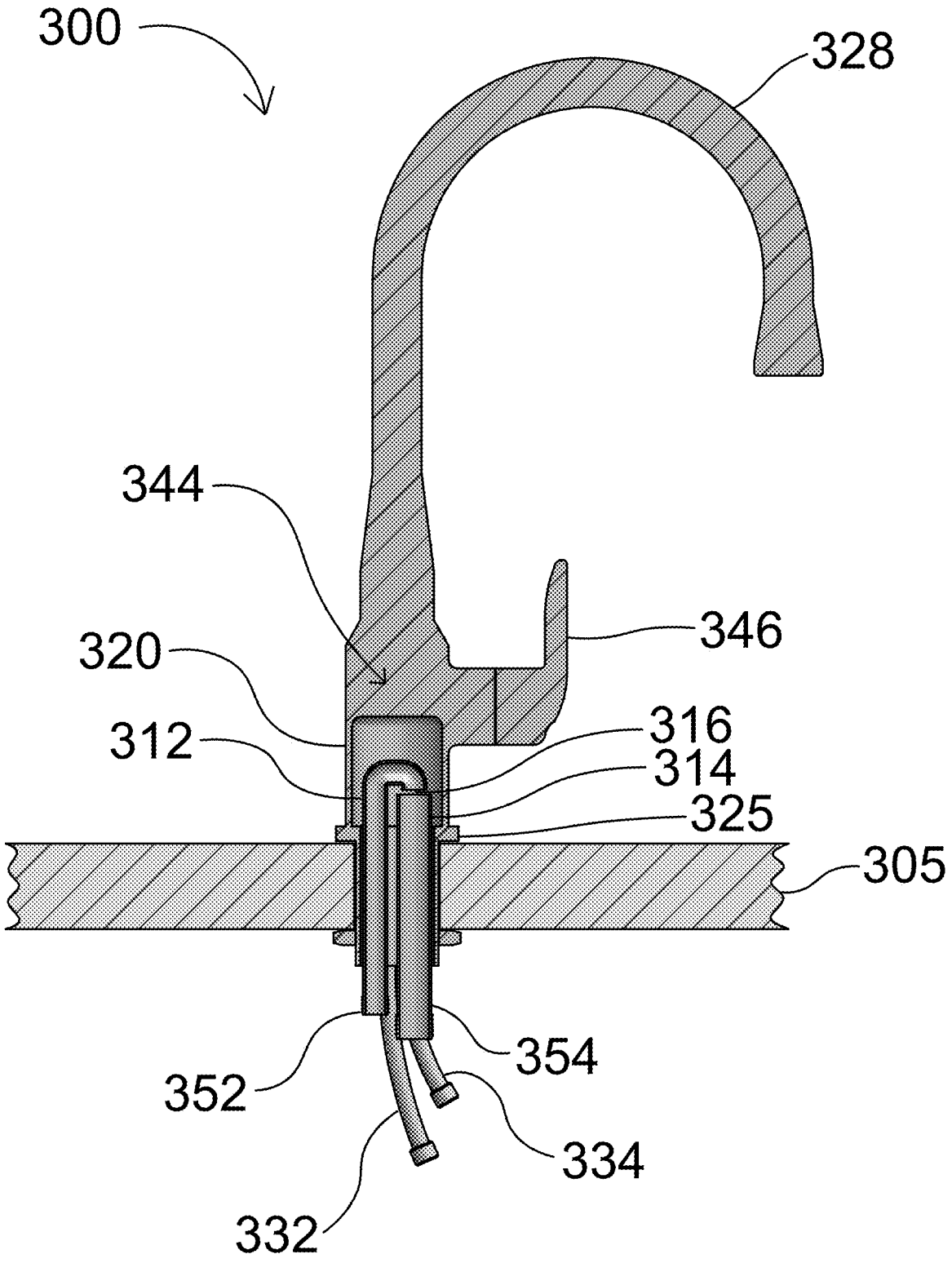
FIG. 3 is a side view of an embodiments of an integrated airgap faucet illustrating an airgap that is integrated into the faucet body of a sink faucet.

FIG. 3 is a side view of an embodiment of an integrated airgap faucet illustrating an airgap that is integrated into the faucet body of a sink faucet. Integrated airgap faucet 300. Integrated airgap faucet 300 includes faucet body 320 that projects through baseplate 325 and countertop 305 where it is secured by a retaining nut. Handle 346 connects to a valve 340 that is inside of handle base 344. Hot water input conduit 332 and cold-water input conduit 334 project from the bottom of faucet body 320 and supply hot water and cold water respectively to faucet output conduit 328. Airgap wastewater conduit 352 is in fluid communication with wastewater input from wastewater input conduit 312 which is part the airgap vent. The airgap vent includes appliance wastewater input conduit 312, gap 316, and output conduit to drain 314.

Figures 4, 4A:
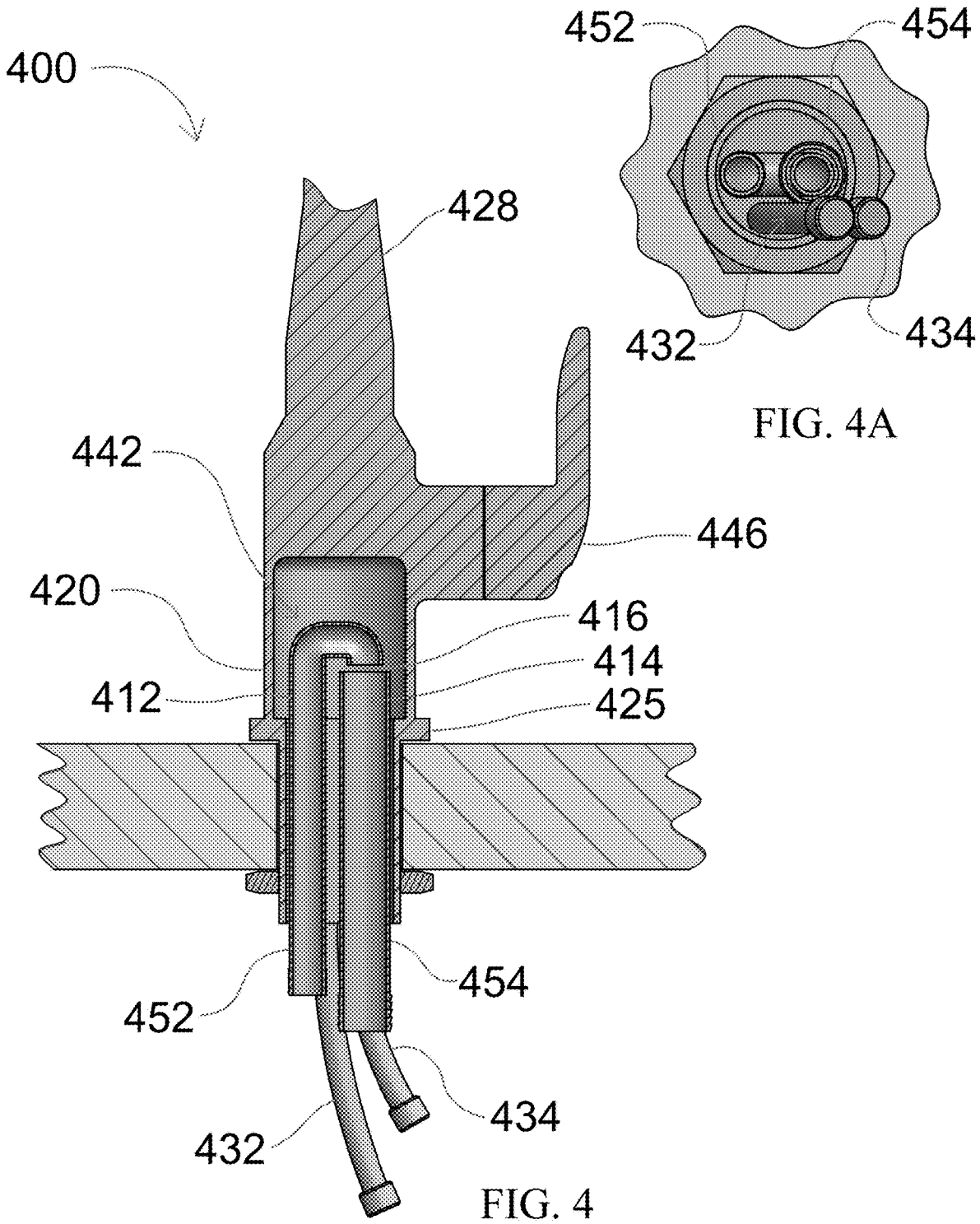
FIG. 4 is a side planar view of an embodiment an integrated airgap faucet similar to the embodiment shown in FIG. 3 that shows the hot water/cold water input lines, an input waste line from a dishwasher to the faucet, and output waste line from the faucet to drain.
FIG. 4A is a top-down cross-section of an embodiment of an integrated airgap faucet at the plane of a baseplate.

FIG. 4 is a side view of an embodiment an integrated airgap faucet similar to the embodiment shown in FIG. 3 that shows the hot water/cold water input lines, an input waste line from a dishwasher to the faucet, and output waste line from the faucet to drain. Integrated airgap faucet 400 includes faucet body 420 that projects through baseplate 425 and countertop (not shown in this illustration where it is secured by a retaining nut. Handle 446 connects to valve 440 that is inside of valve body 442. Hot water input conduit 432 and cold-water input conduit 434 (hidden from view) project from the bottom of faucet body 420 and supply hot water and cold water respectively to faucet output conduit 428. Appliance wastewater conduit 452 is in fluid communication with wastewater input from appliance 412 which is part the airgap vent. The airgap vent includes appliance wastewater input conduit 412, gap 416, and output conduit to drain 414.

FIG. 4A is a top down cross-section of the embodiment illustrated in FIG. 4. The view is from along view line A along retaining nut 426. The illustration shows that faucet body 420 is fed by four conduits—hot water input conduit 452, cold water input conduit 434, appliance output conduit 454 and airgap vent output conduit 452.

Figure 5:
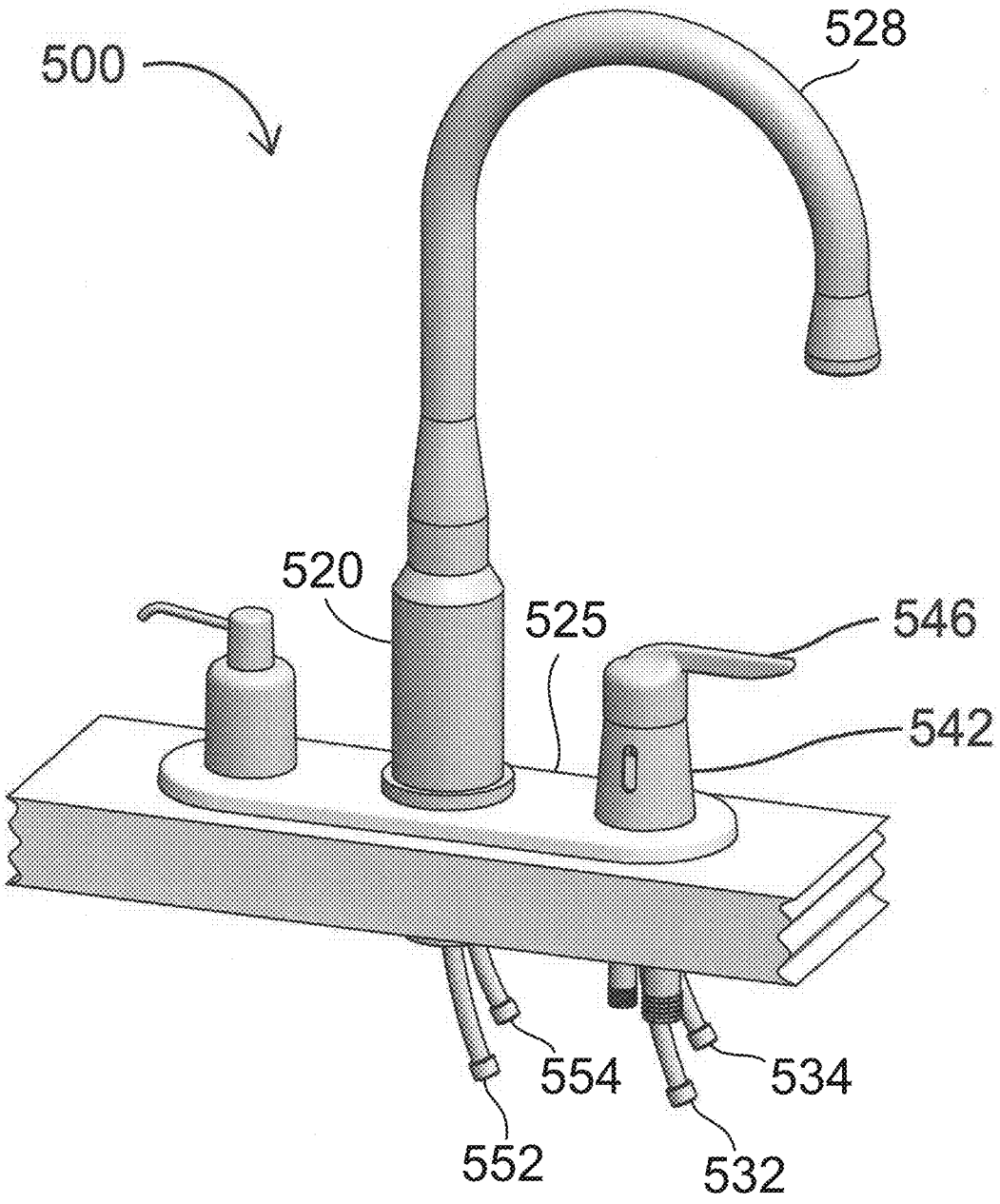
FIG. 5 is a side perspective views of an embodiment of an integrated airgap faucet where the airgap is integrated into the faucet valve handle.
Figure 6:
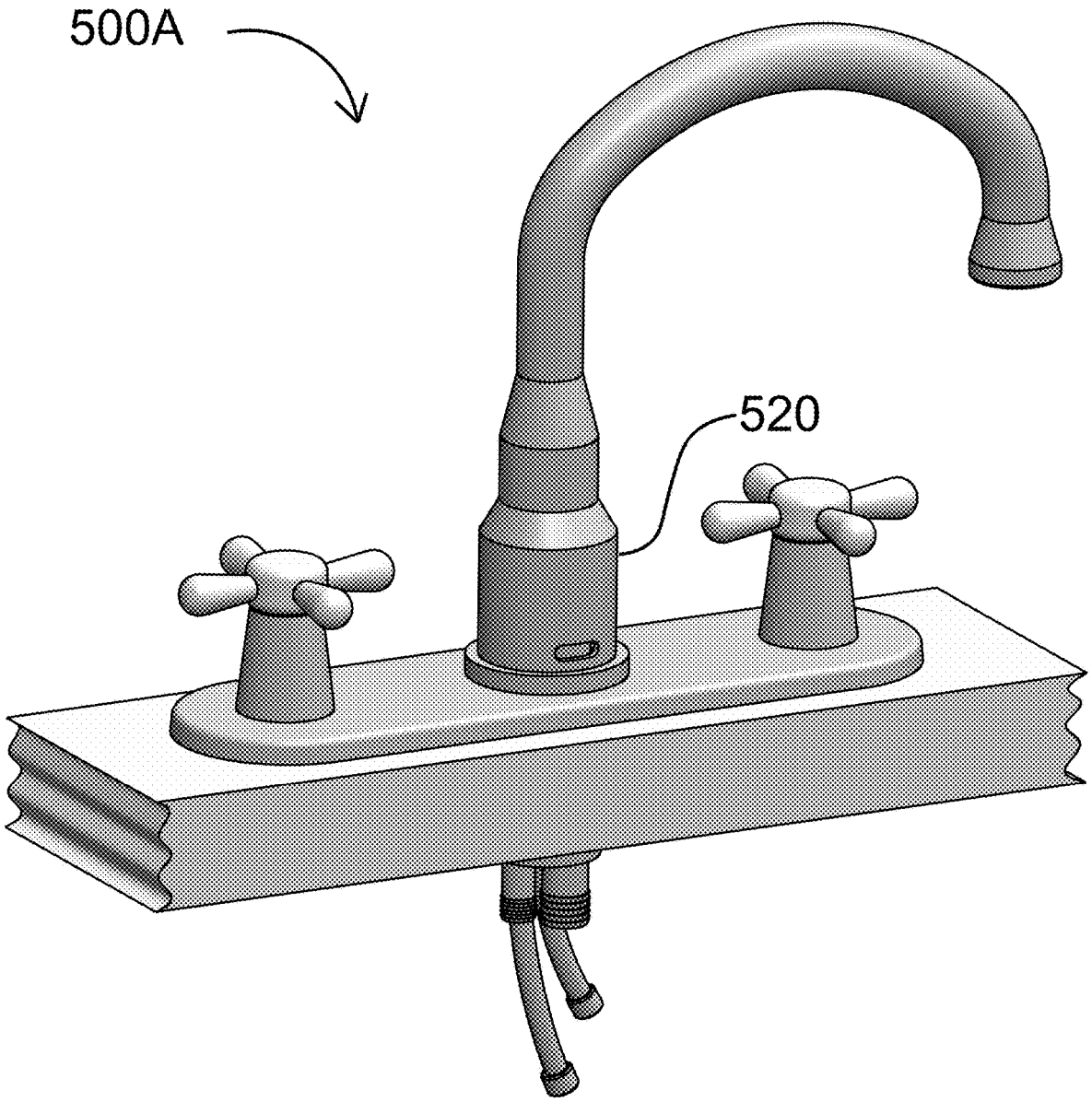
FIG. 6 is a different side perspective view of an embodiment of an integrated airgap faucet wherein the airgap is integrated into the faucet body and has two separate water valves.

FIG. 5 is a side perspective view of an embodiment of an integrated airgap faucet where the airgap is integrated into the faucet valve handle. FIG. 5 illustrates an embodiment of an integrated airgap faucet in which the disclosed airgap vent integrated into valve base 542 that is attached to handle 546. FIG. 5 also shows faucet body 520 extending through baseplate 525 as well as hot water input conduit 552 and cold water input conduit 554 inside faucet body 520. Wastewater input conduit 532 and airgap vent output conduit 534 are in fluid communication with disclosed airgap vent integrated into valve base 542. FIG. 6 illustrates an embodiment of an integrated airgap faucet 500A which includes a faucet with two separate water valves. In this embodiment, the airgap vent is integrated into faucet body 520.

Figure 7:
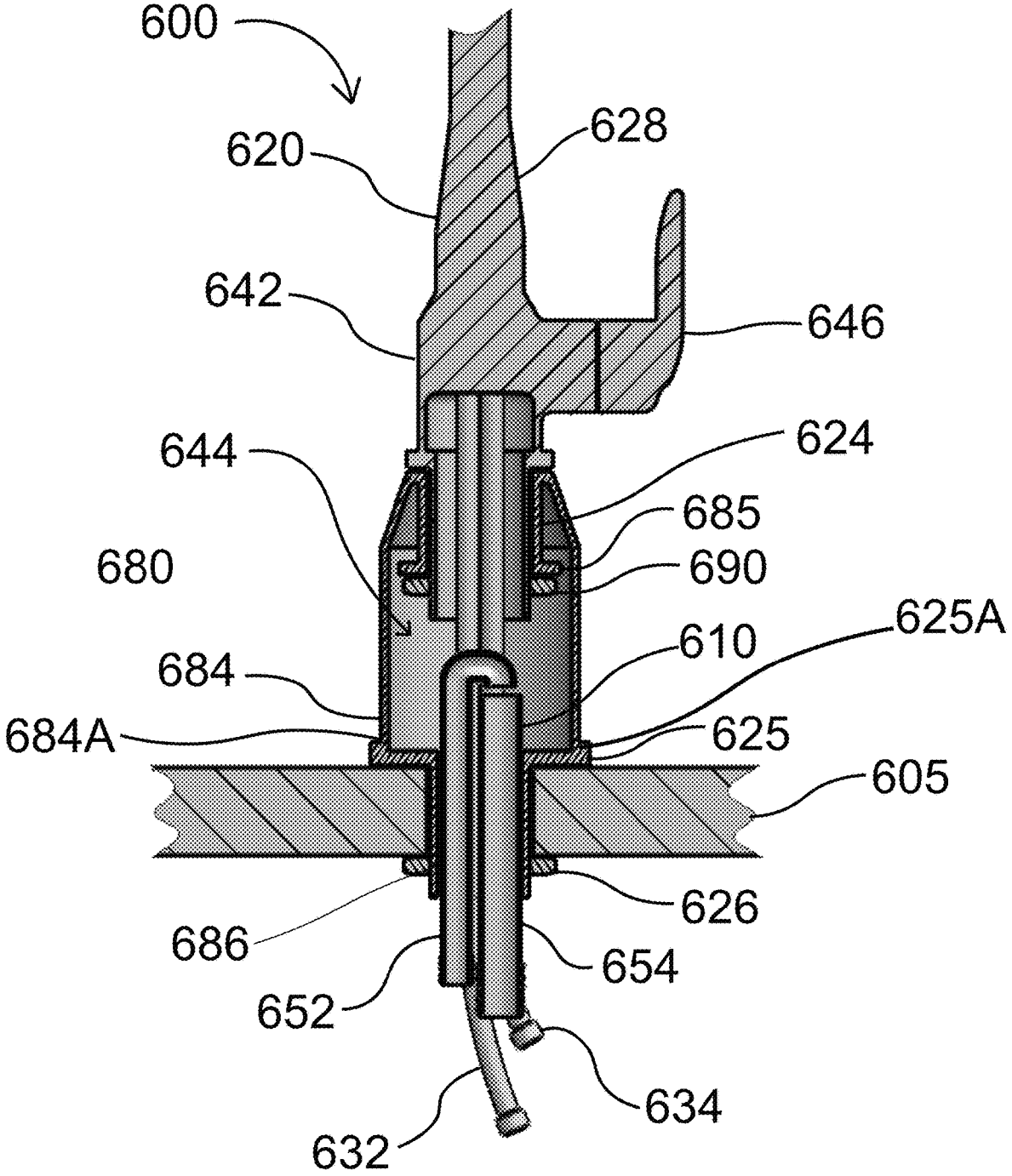
FIG. 7 is a side planar view of an embodiment of an integrated airgap faucet that includes a retrofit body.

FIG. 7 is a side planar view of an embodiment of an integrated airgap faucet that includes a retrofit body. Integrated airgap faucet 600 faucet body 620 projects through retrofit body 680. Handle 646 connects to valve that is inside of valve body 642. Faucet body 620 is secured to flange 685 on the top interior portion of retrofit body 680. Retrofit body 680 projects through countertop 605 and is and is secured by retaining ring 626. Appliance wastewater conduit 652 is in fluid communication with the wastewater input from an appliance (not shown) which is part the airgap vent 610. Hollow cavity 644 includes axially symmetric portion 684 structured and configured to contain integrated airgap vent 610. Hollow cavity 644 of retrofit body 680 also includes interior flange 685 that is contiguous with the end of fixture cavity conduit 624. Interior flange 685 extends away from the interior of fixture cavity conduit 624. Finally, hollow cavity 644 includes airgap conduit 686 that is structured and configured to allow airgap vent 610 to be inserted therethrough. Faucet body 620 is secured to the interior flange 685 by a faucet retaining nut 690 that is threaded onto the pre-existing threads (not shown) of Faucet body 620. Hollow cavity 644, as shown, includes seating flange 625. Seating flange 625 is structured and configured to stabilize retrofit body 680 when retrofit body 680 is inserted into a hole in a sink or countertop. Seating flange 625 may be connected to the axially symmetric portion 684 at upper connection area 625A on the interior of seating flange 625 and at the lower connection area 684A disposed at the base of axially symmetric portion 684. When seating flange 625 is disconnected from axially symmetric portion 684 access to the faucet retaining nut 690 may be obtained.

Figure 8:
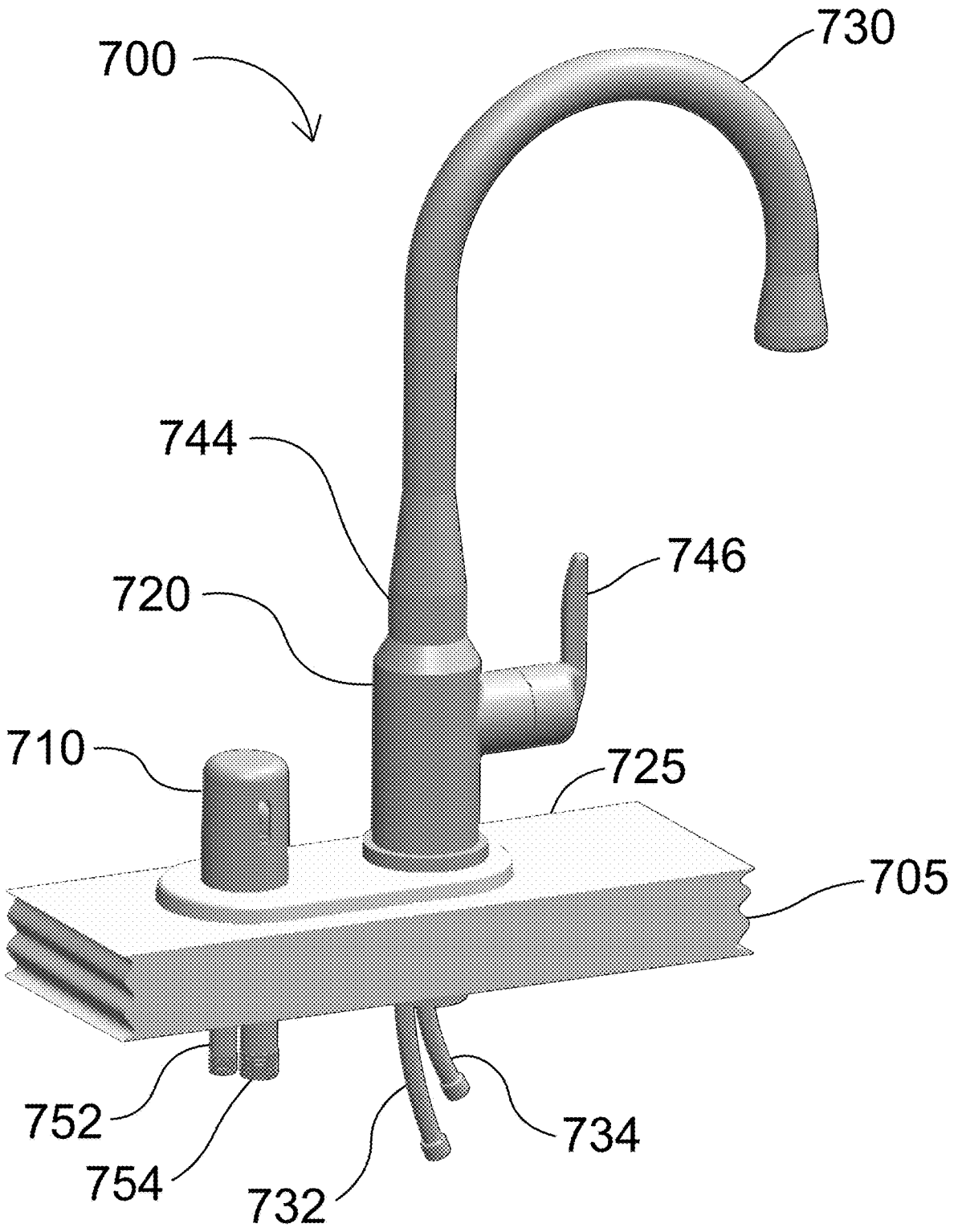
FIG. 8 is a side perspective illustration of an embodiment an integrated airgap faucet illustrating an airgap that is integrated into the baseplate of a sink faucet.

FIG. 8 is a side perspective view of an embodiment an integrated airgap faucet illustrating an airgap that is integrated into the baseplate of a sink faucet. Integrated airgap faucet 700 includes faucet body 720 that projects through baseplate 725 and countertop 705 where it is secured by a retaining nut. Faucet body 720 is in fluid communication with spout 730 which delivers water to a sink. Handle 746 connects to a valve (not shown) that is inside of the handle base 744. In this embodiment, faucet body 720 and handle base 744 are one and the same. Hot water input conduit 732 and cold-water input conduit 734 project from the bottom of faucet body 720 and supply hot water and cold water respectively to spout 730. Airgap valve 710 also projects through baseplate 725 and includes projects through countertop 705. Appliance output conduit 754 and airgap vent conduit 752 are shown below countertop 705 and can connect to an appliance drain and drainpipe respectively.

Figure 9A:
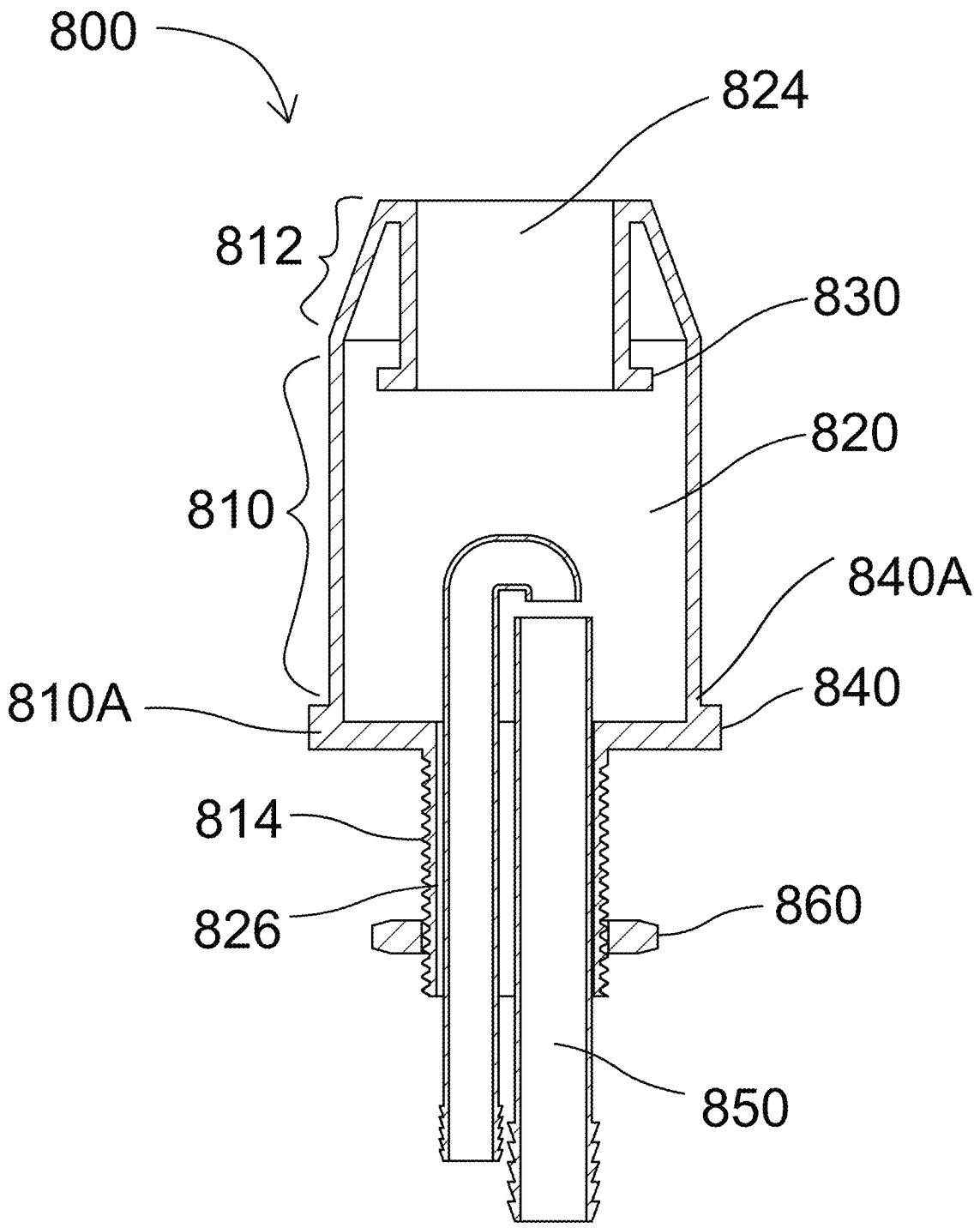
FIG. 9A is a side planar view illustration of a bisection of an embodiment of a retrofit body.
Figure 9B:
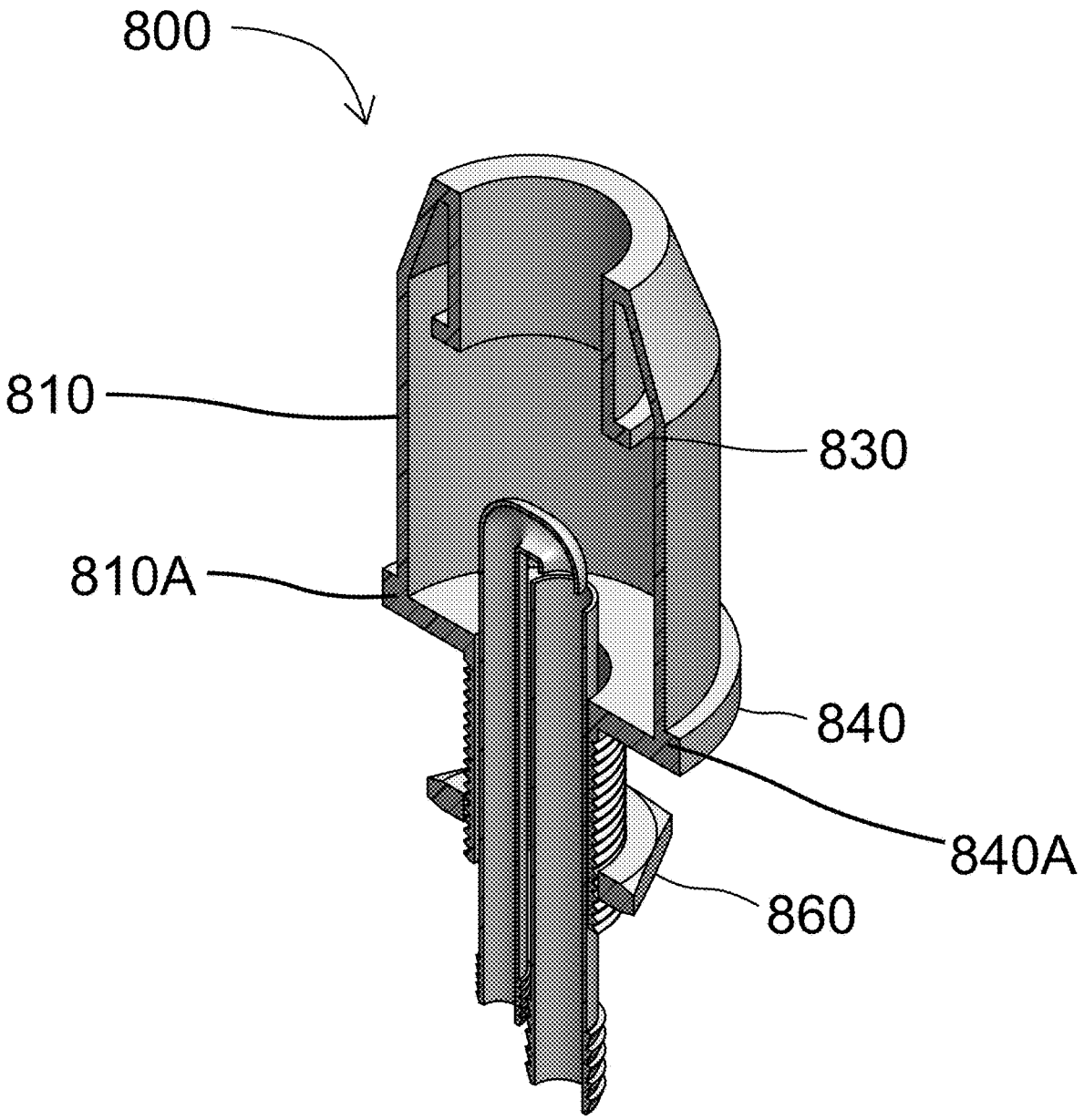
FIG. 9B is a perspective view of the bisection of the embodiment of the retrofit body illustrated in FIG. 9A.
Figure 9C:
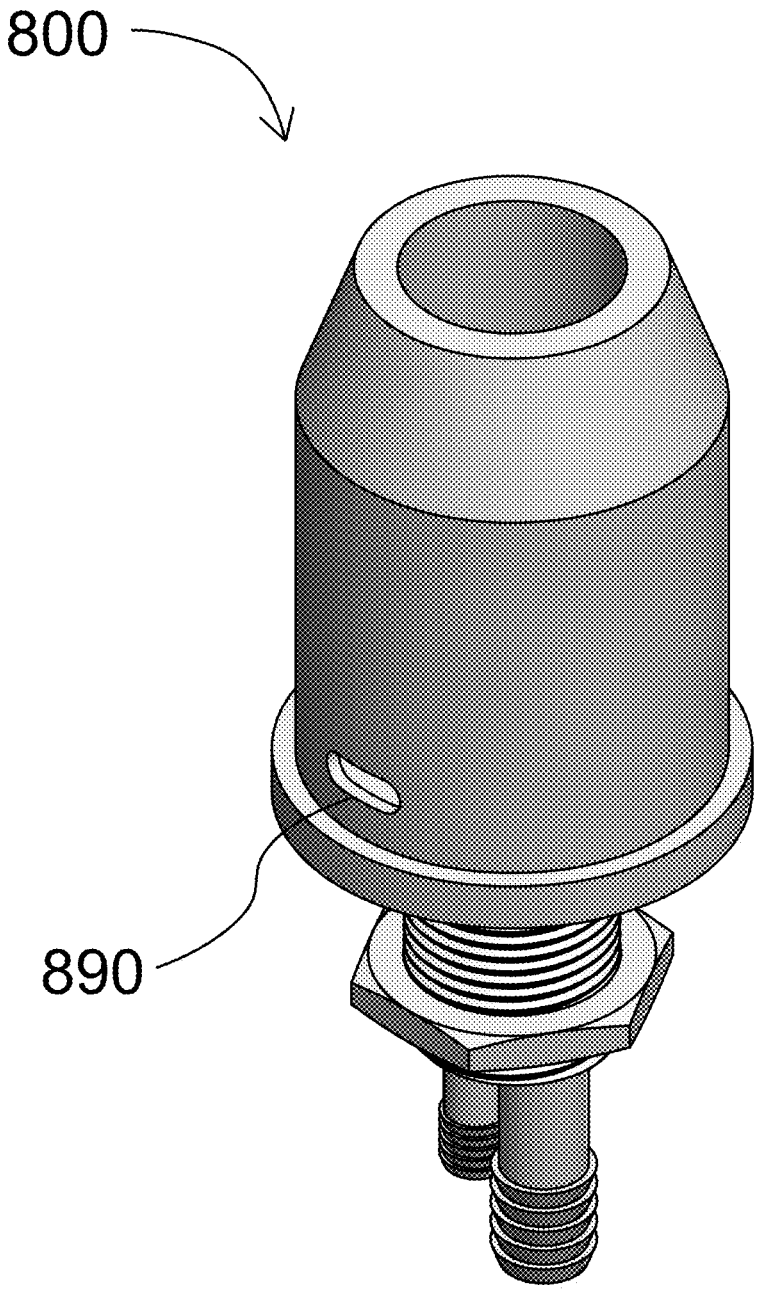
FIG. 9C is a perspective view of the embodiment of the outside of the retrofit body illustrated in FIG. 9B.

FIGS. 9A-9C are illustrations of an embodiment of a retrofit body 800 according to this disclosure. FIG. 9A is a side planar view illustration of a bisection of the embodiment of a retrofit body. FIG. 9B is a perspective view of the bisection of the embodiment of the retrofit body illustrated in FIG. 9A. FIG. 9C is a perspective view of the embodiment of the outside of the retrofit body illustrated in FIG. 9B. Retrofit body 800 is shown as one continuous part that is arranged as follows. Retrofit body 800 includes hollow cavity 820 that is substantially cylindrical in shape. In this application substantially cylindrical refers to the arrangement in which wall 810 of retrofit body 800 completely surrounds hollow cavity 820. The profile of a horizontal cross section of hollow cavity 820 can be circular, or can have the shape of any regular polygon such as, for example, a square, hexagon, etc. It is also contemplated that the horizontal cross section of the hollow cavity can be somewhat irregular such as an oval or slightly rectangular. Hollow cavity 820, shown as having a circular horizontal cross section, has a diameter. Hollow cavity 820 also includes fixture cavity conduit 824 at one end and airgap vent conduit 826 at an opposing end. Hollow cavity 820 includes axially symmetric portion 810 structured and configured to contain integrated airgap vent 850.

Hollow cavity 820 also includes tapered portion 812 that is contiguous with one end of the axially symmetric section. Tapered portion 812 reduces the diameter of hollow cavity 820 and is in communication with fixture cavity conduit 824. Fixture cavity conduit 824 extends toward the inside of cavity 820.

Hollow cavity 820 of retrofit body 800 also includes interior flange 830 that is contiguous with the end of fixture cavity conduit 824. Interior flange 830 extends away from the interior of fixture cavity conduit 824. Finally, hollow cavity 820 includes airgap conduit 826 that is structured and configured to allow airgap vent 850 to be inserted therethrough.

The embodiment illustrated in FIGS. 9A-C also include threads 814 on the exterior of airgap conduit 826. Hollow cavity 820, as shown, includes seating flange 840. Seating flange 840 is structured and configured to stabilize retrofit body 800 when retrofit body 800 is inserted into a hole in a sink or countertop. Seating flange 840 may be connected to the axially symmetric portion 810 at upper connection area 840A on the interior of seating flange 840 and with the lower connection area 810A disposed at the base of axially symmetric portion 810. Retrofit body 800 can also include airgap vent 850 that, in FIGS. 9A-C are inserted through airgap conduit 826 and into hollow cavity 820. Retrofit body 800 as shown in the accompanying illustrations include at least one retaining nut 860 engaged with threads 814 on the exterior wall of airgap conduit 826. In some embodiments, wall 810 of disclosed retrofit body can have pressure equalizing vent 890 projecting through wall 810 and into hollow cavity 820.

Figure 10:
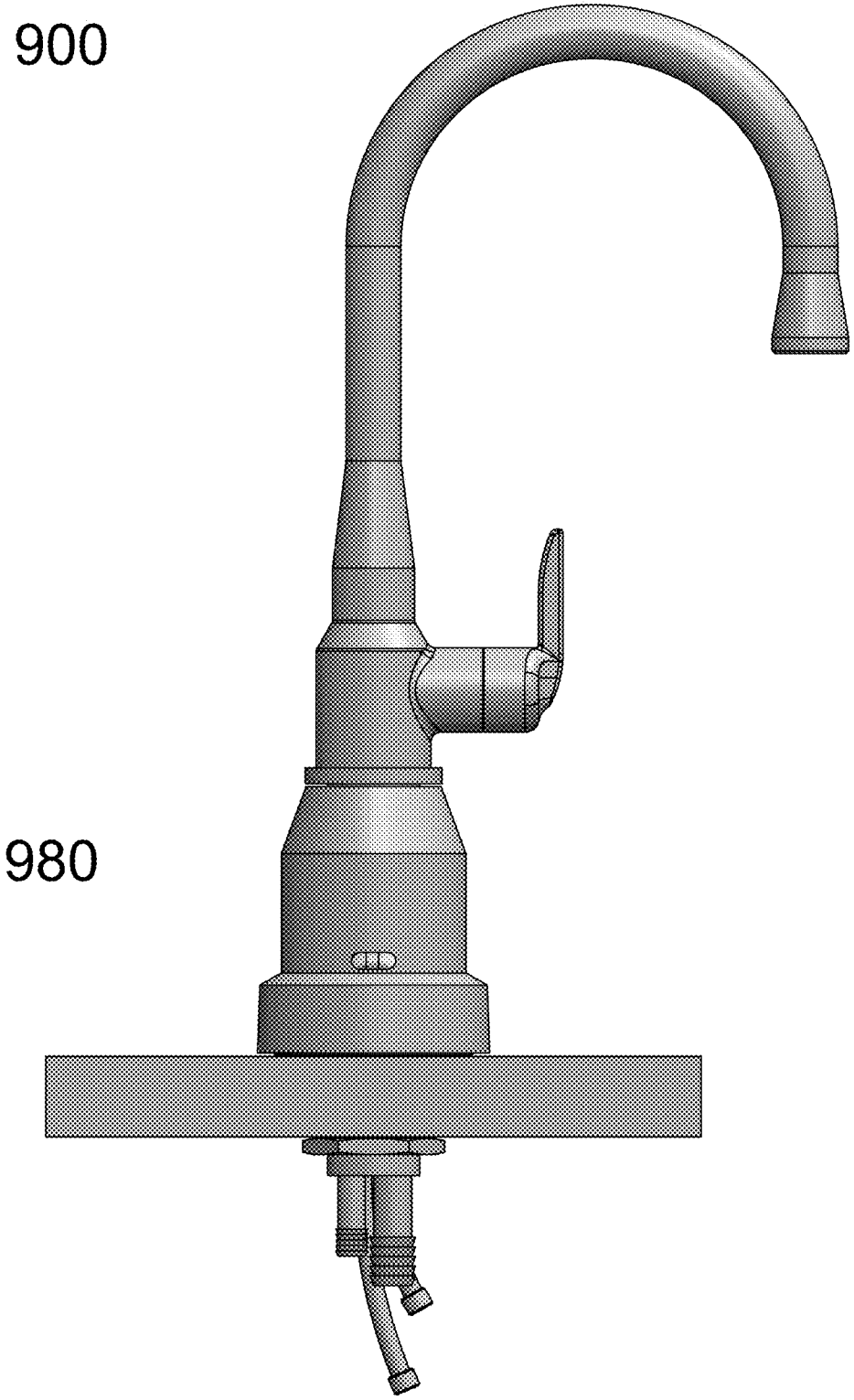
FIG. 10 is a side view of an embodiment of an integrated airgap faucet that includes a retrofit body.

FIG. 10 is a side view of an embodiment of an integrated airgap faucet that includes a retrofit body 980. This retrofit body 900 uses a compression fitting 988 in FIG. 10A to hold the axially symmetric portion 984 together with seating flange 925; this is an example of a means to give access to the hollow cavity 944 to assist in installation of the faucet body 920 into the retrofit body 980.

Figure 10A:
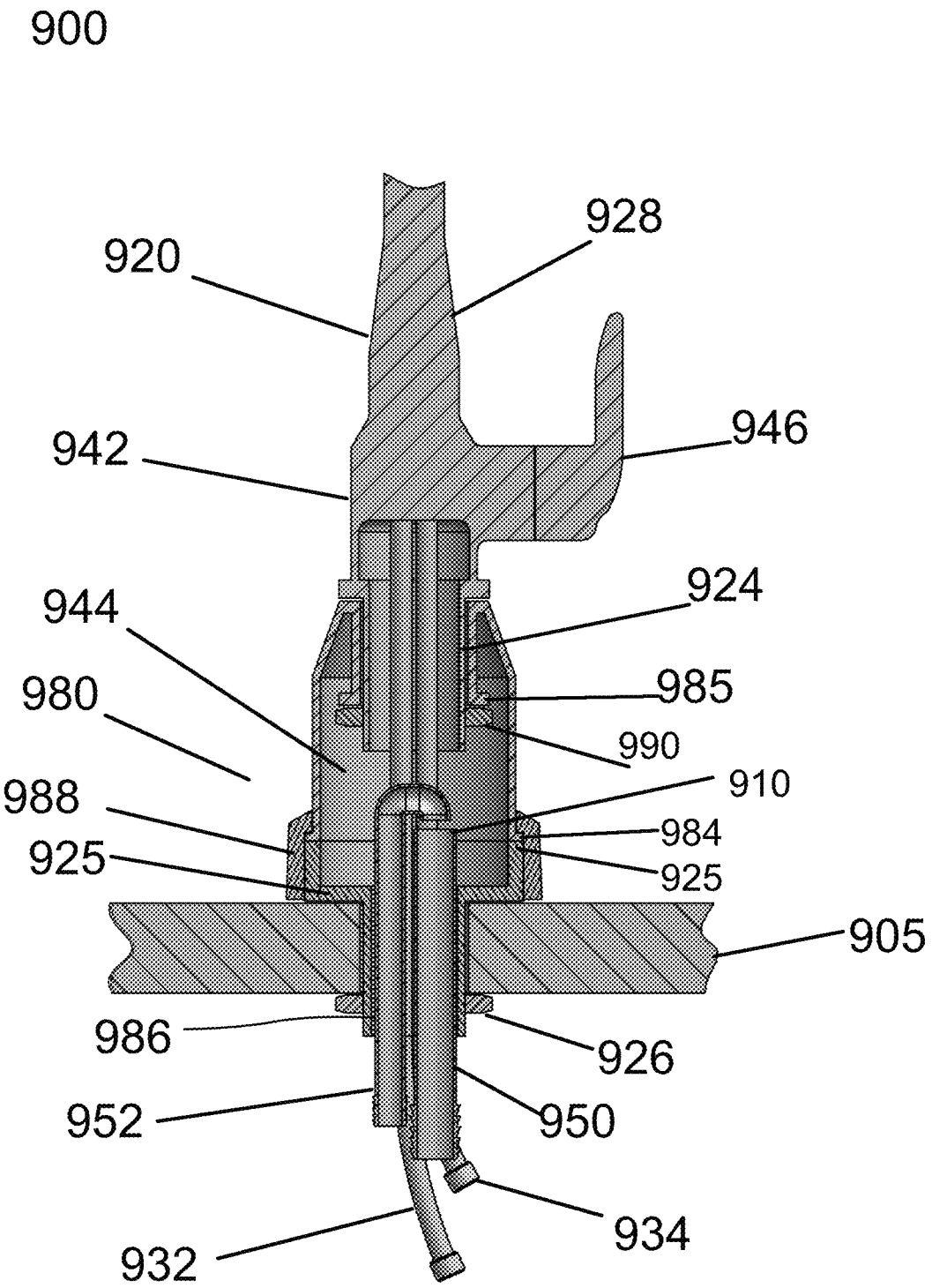
FIG. 10A is a side planar view of the embodiment of an integrated airgap faucet that includes a retrofit body illustrated in FIG. 10.

FIG. 10A is a side planar view of an embodiment of an integrated airgap faucet that includes a retrofit body 980. Integrated airgap faucet 900 faucet body 920 projects through retrofit body 980. Handle 946 connects to the valve that is inside of valve body 942. Faucet body 920 is secured to flange 985 on the top interior portion of retrofit body 980. Retrofit body 980 projects through countertop 905 and is and is secured by retaining ring 926. Appliance wastewater conduit 952 is in fluid communication with the wastewater input from an appliance (not shown) which is part the airgap vent 910. Hollow cavity 944 includes axially symmetric portion 984 structured and configured to contain integrated airgap vent 910. Hollow cavity 944 of retrofit body 980 also includes interior flange 985 that is contiguous with the end of fixture cavity conduit 924. Interior flange 985 extends away from the interior of fixture cavity conduit 924. Finally, hollow cavity 944 includes airgap conduit 986 that is structured and configured to allow airgap vent 950 to be inserted therethrough. Faucet body 920 is secured to the interior flange 985 by a faucet retaining nut 990 that is threaded onto the pre-existing threads (not shown) of Faucet body 920. Hollow cavity 944, as shown, includes seating flange 925. Seating flange 925 is structured and configured to stabilize retrofit body 980 when retrofit body 980 is inserted into a hole in a sink or countertop. Seating flange 925 may be connected to the axially symmetric portion 984 with the compression provided by compression fitting 988 which compress the seating flange 925 and axially symmetric portion 984 together once installation of faucet body 920 is complete. When seating flange 925 is disconnected from axially symmetric portion 984 by removal of compression fitting 988 access to the faucet retaining nut 990 may be obtained.

Figure 10B:
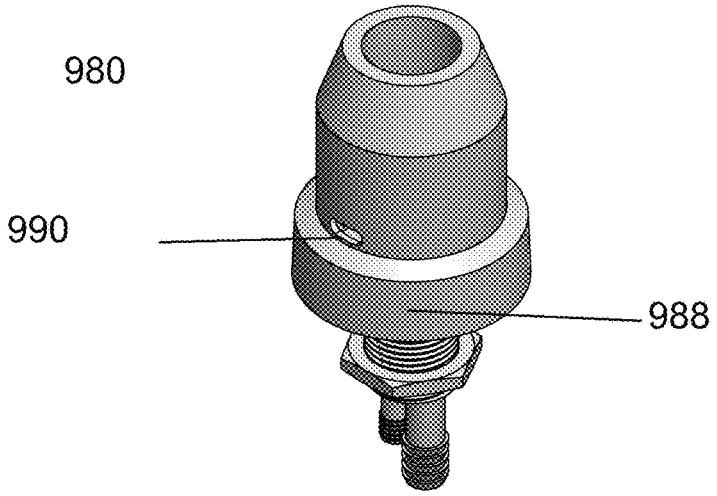
FIG. 10B is a perspective view of the embodiment of the retrofit body illustrated in FIG. 10.
Figure 10C:
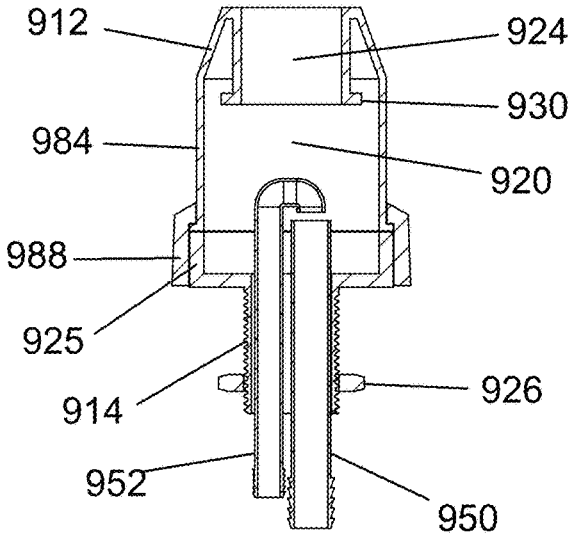
FIG. 10C is a side planar view illustration of a bisection of an embodiment of a retrofit body illustrated in FIG. 10B.
Figure 10D:
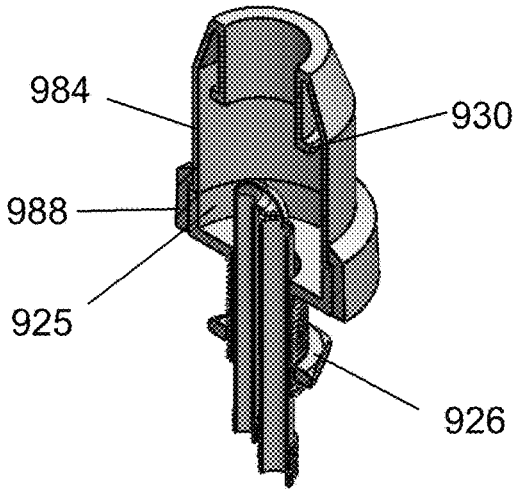
FIG. 10D is a perspective view of the bisection of the embodiment of the retrofit body illustrated in FIG. 10B.

FIGS. 10B-10D are illustrations of an embodiment of a retrofit body 980 according to this disclosure. FIG. 10B is a perspective view of the embodiment of the outside of the retrofit body 980. FIG. 10C is a side planar view illustration of a bisection of the embodiment of a retrofit body 980. FIG. 10D is a perspective view of the bisection of the embodiment of the retrofit body 980 illustrated in FIG. 10C. Retrofit body 980 is shown as one continuous part that is arranged as follows. Retrofit body 980 includes hollow cavity 920 that is substantially cylindrical in shape. In this application substantially cylindrical refers to the arrangement in which axially symmetric portion 984 of retrofit body 980 completely surrounds hollow cavity 920. The profile of a horizontal cross section of hollow cavity 920 can be circular, or can have the shape of any regular polygon such as, for example, a square, hexagon, etc. It is also contemplated that the horizontal cross section of the hollow cavity can be somewhat irregular such as an oval or slightly rectangular. Hollow cavity 920, shown as having a circular horizontal cross section, has a diameter. Hollow cavity 920 also includes fixture cavity conduit 924 at one end and airgap vent conduit 986 at an opposing end. Hollow cavity 920 includes axially symmetric portion 984 structured and configured to contain integrated airgap vent 950.

Hollow cavity 920 also includes tapered portion 912 that is contiguous with one end of the axially symmetric section 984. Tapered portion 912 reduces the diameter of hollow cavity 920 and is in communication with fixture cavity conduit 924. Fixture cavity conduit 924 extends toward the inside of cavity 920.

Hollow cavity 920 of retrofit body 980 also includes interior flange 930 that is contiguous with the end of fixture cavity conduit 924. Interior flange 930 extends away from the interior of fixture cavity conduit 924. Finally, hollow cavity 920 includes airgap conduit 986 that is structured and configured to allow airgap vent 950 to be inserted therethrough.

The embodiment illustrated in FIGS. 10B-D also include threads 914 on the exterior of airgap conduit 926. Hollow cavity 920, as shown, includes seating flange 925. Seating flange 925 is structured and configured to stabilize retrofit body 980 when retrofit body 980 is inserted into a hole in a sink or countertop. Seating flange 925 may be connected to the axially symmetric portion 984 with the compression provided by compression fitting 988 which compress the seating flange 925 and axially symmetric portion 984 together once installation of faucet body 920 is complete. Retrofit body 980 can also include airgap vent 950 that in FIGS. 10B-D is inserted through airgap conduit 986 and into hollow cavity 920. Retrofit body 980 as shown in the accompanying illustrations include at least one retaining nut 926 engaged with threads 914 on the exterior wall of airgap conduit 986. In some embodiments, axially symmetric portion 984 of disclosed retrofit body 980 can have pressure equalizing vent 990 projecting through axially symmetric portion 984 and into hollow cavity 920.

Figure 11:
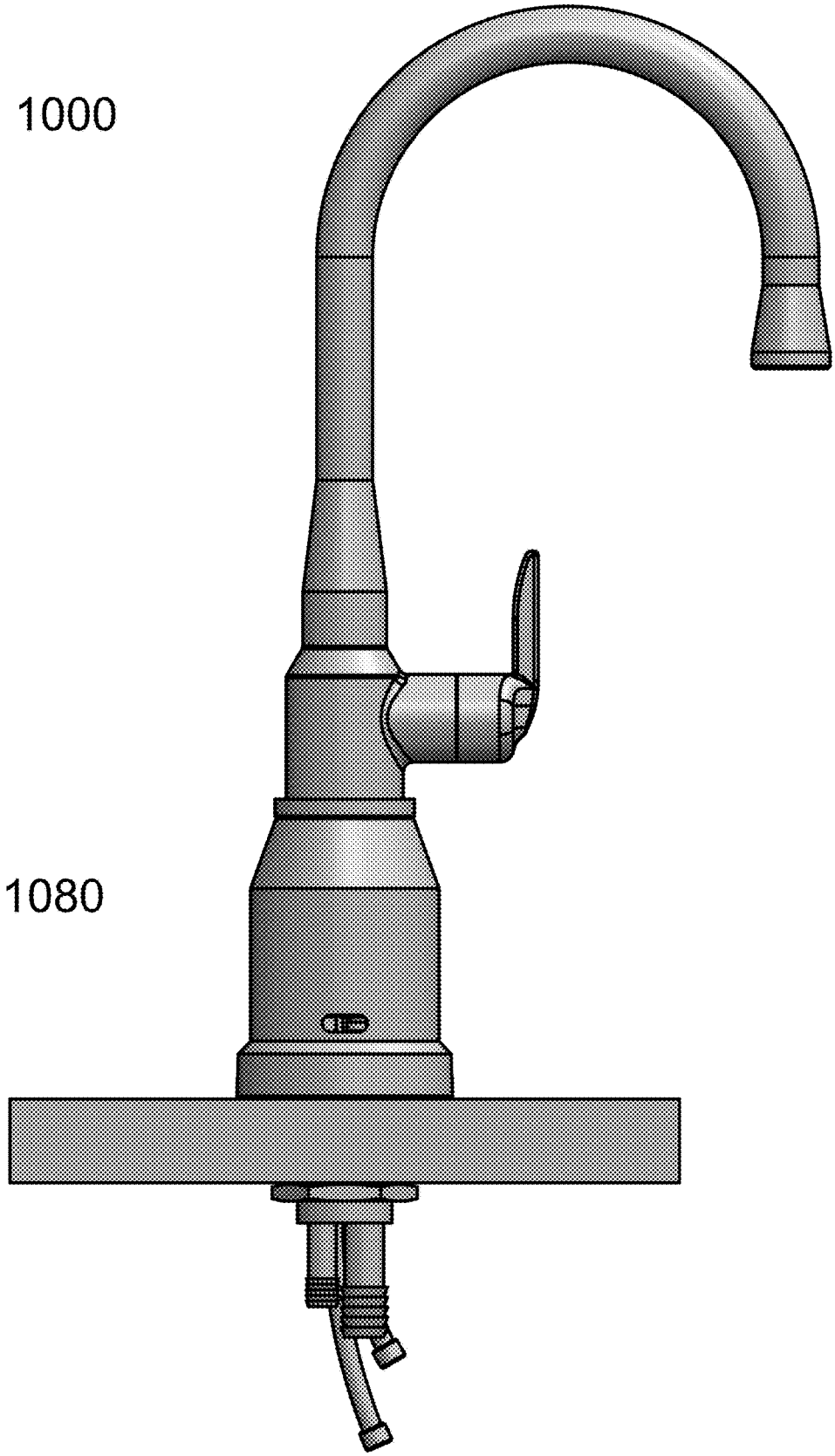
FIG. 11 is a side view of an embodiment of an integrated airgap faucet that includes a retrofit body.

FIG. 11 is a side view of an embodiment of an integrated airgap faucet 1000 that includes a retrofit body 1080. This retrofit body 1080 uses set screws 1088 disposed within axially symmetric portion 1084 to secure axially symmetric portion 1084 to the seating flange 1025 in FIG. 11A; this is an example of a means to give access to the hollow cavity 1044 to assist in installation of the faucet body 1020 in to the retrofit body 1080.

Figure 11A:
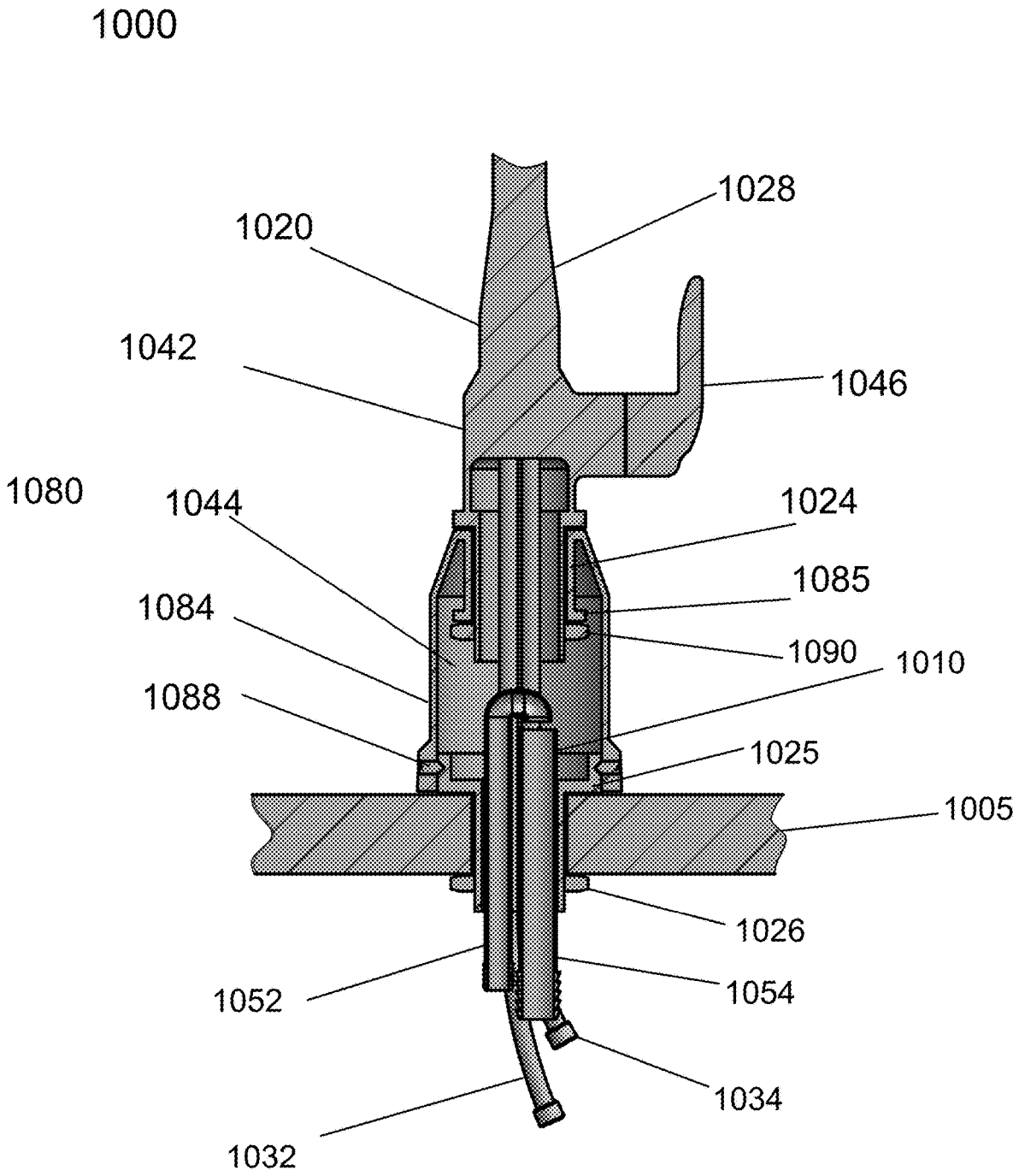
FIG. 11A is a side planar view of the embodiment of an integrated airgap faucet that includes a retrofit body illustrated in FIG. 11.

FIG. 11A is a side planar view of an embodiment of an integrated airgap faucet that includes a retrofit body 1080. Integrated airgap faucet 1000 faucet body 1020 projects through retrofit body 1080. Handle 1046 connects to the valve that is inside of valve body 1042. Faucet body 1020 is secured to flange 1085 on the top interior portion of retrofit body 1080. Retrofit body 1080 projects through countertop 1005 and is and is secured by retaining ring 1026. Appliance wastewater conduit 1052 is in fluid communication with the wastewater input from an appliance (not shown) which is part the airgap vent 1050. Hollow cavity 1044 includes axially symmetric portion 1084 structured and configured to contain integrated airgap vent 1050. Hollow cavity 1044 of retrofit body 1080 also includes interior flange 1085 that is contiguous with the end of fixture cavity conduit 1024. Interior flange 1085 extends away from the interior of fixture cavity conduit 1024. Finally, hollow cavity 1044 includes airgap conduit 1052 that is structured and configured to allow airgap vent 1050 to be inserted therethrough. Faucet body 1020 is secured to the interior flange 1085 by a faucet retaining nut 1090 that is threaded onto the pre-existing threads (not shown) of Faucet body 1020. Hollow cavity 1044, as shown, includes seating flange 1025. Seating flange 1025 is structured and configured to stabilize retrofit body 1080 when retrofit body 1080 is inserted into a hole in a sink or countertop. Seating flange 1025 may be connected to the axially symmetric portion 1084 with the compression provided by set screws 1088 which compress the seating flange 1025 and axially symmetric portion 1084 together once installation of faucet body 1020 is complete. When seating flange 1025 is disconnected from axially symmetric portion 1084 by removal of set screws 1088 access to the faucet retaining nut 1090 may be obtained.

Figure 11B:
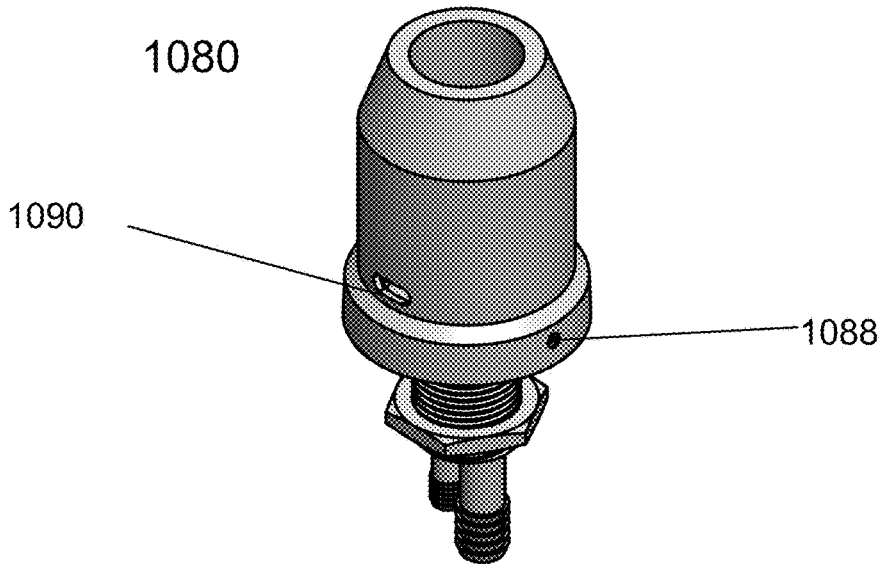
FIG. 11B is a perspective view of the embodiment of the retrofit body illustrated in FIG. 11.
Figure 11C:
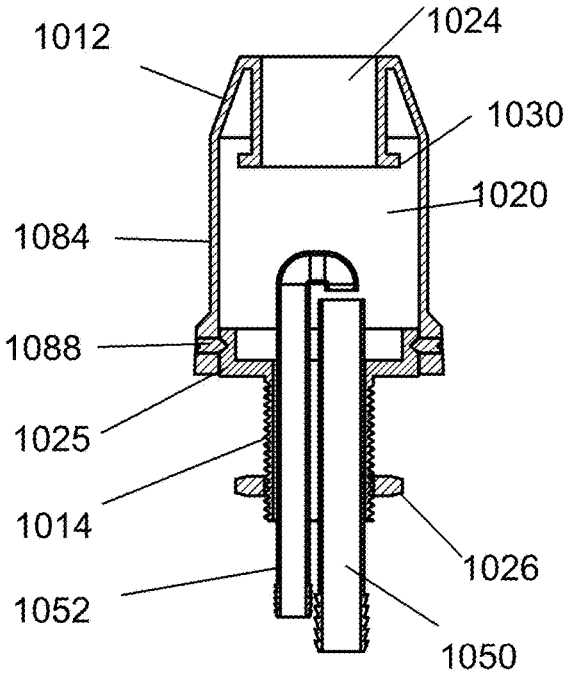
FIG. 11C is a side planar view illustration of a bisection of an embodiment of a retrofit body illustrated in FIG. 11B.
Figure 11D:
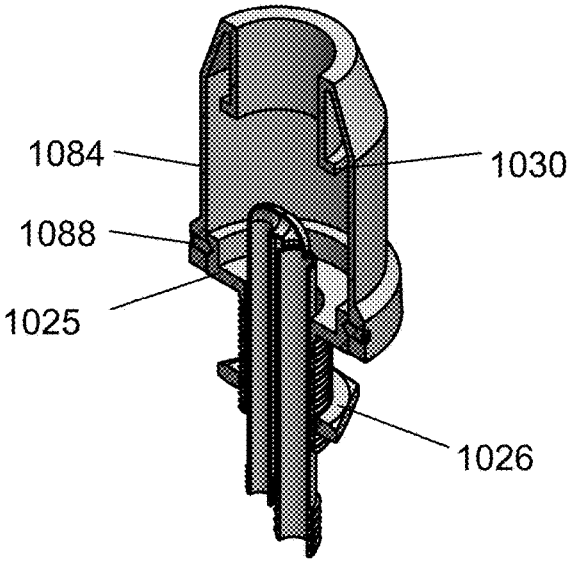
FIG. 11D is a perspective view of the bisection of the embodiment of the retrofit body illustrated in FIG. 11B.

FIGS. 11B-11D are illustrations of an embodiment of a retrofit body 1080 according to this disclosure. FIG. 11B is a perspective view of the embodiment of the outside of the retrofit body 1080. FIG. 11C is a side planar view illustration of a bisection of the embodiment of a retrofit body 1080. FIG. 11D is a perspective view of the bisection of the embodiment of the retrofit body 1080 illustrated in FIG. 11C. Retrofit body 1080 is shown as one continuous part that is arranged as follows. Retrofit body 1080 includes hollow cavity 1020 that is substantially cylindrical in shape. In this application substantially cylindrical refers to the arrangement in which axially symmetric portion 1084 of retrofit body 1080 completely surrounds hollow cavity 1020. The profile of a horizontal cross section of hollow cavity 1020 can be circular, or can have the shape of any regular polygon such as, for example, a square, hexagon, etc. It is also contemplated that the horizontal cross section of the hollow cavity can be somewhat irregular such as an oval or slightly rectangular. Hollow cavity 1020, shown as having a circular horizontal cross section, has a diameter. Hollow cavity 1020 also includes fixture cavity conduit 1024 at one end and airgap vent conduit 1026 at an opposing end. Hollow cavity 1020 includes axially symmetric portion 1084 structured and configured to contain integrated airgap vent 1050.

Hollow cavity 1020 also includes tapered portion 1012 that is contiguous with one end of the axially symmetric section 1084. Tapered portion 1012 reduces the diameter of hollow cavity 1020 and is in communication with fixture cavity conduit 1024. Fixture cavity conduit 1024 extends toward the inside of cavity 1020.

Hollow cavity 1020 of retrofit body 1080 also includes interior flange 1030 that is contiguous with the end of fixture cavity conduit 1024. Interior flange 1030 extends away from the interior of fixture cavity conduit 1024. Finally, hollow cavity 1020 includes airgap conduit 1026 that is structured and configured to allow airgap vent 1050 to be inserted therethrough.

The embodiment illustrated in FIGS. 11B-D also include threads 1014 on the exterior of airgap conduit 1026. Hollow cavity 1020, as shown, includes seating flange 1025. Seating flange 1025 is structured and configured to stabilize retrofit body 1080 when retrofit body 1080 is inserted into a hole in a sink or countertop. Seating flange 1025 may be connected to the axially symmetric portion 1084 with the compression provided by set screws 1088 which compress the seating flange 1025 and axially symmetric portion 1084 together once installation of faucet body 1020 is complete. Retrofit body 1080 can also include airgap vent 1050 that in FIGS. 11B-D is inserted through airgap conduit 1026 and into hollow cavity 1020. Retrofit body 1080 as shown in the accompanying illustrations include at least one retaining nut 1060 engaged with threads 1014 on the exterior wall of airgap conduit 1026. In some embodiments, axially symmetric portion 1084 of disclosed retrofit body 1080 can have pressure equalizing vent 1090 projecting through axially symmetric portion 1084 and into hollow cavity 1020.

Figure 12:
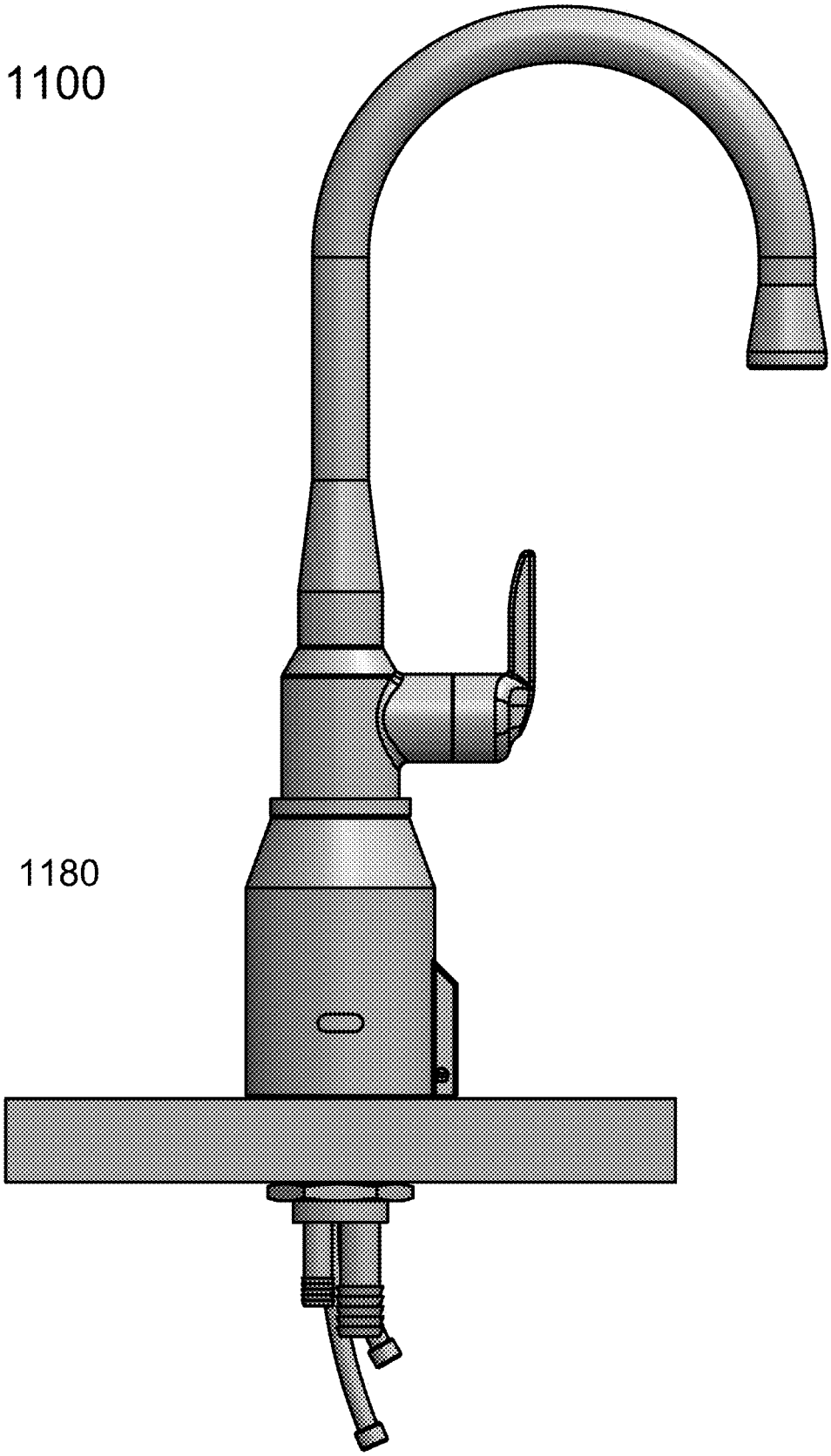
FIG. 12 is a side view of an embodiment of an integrated airgap faucet that includes a retrofit body.

FIG. 12 is a side view of an embodiment of an integrated airgap faucet 1100 that includes a retrofit body 1180. This retrofit body 1180 uses compression flanges 1188 in conjunction with set screws 1188A disposed on axially symmetric portion 1184 to secure axially symmetric portion 1184 to the seating flange 1125 in FIG. 12A; this is an example of a means to give access to the hollow cavity 1144 to assist in installation of the faucet body 1120 in to the retrofit body 1180.

Figure 12A:
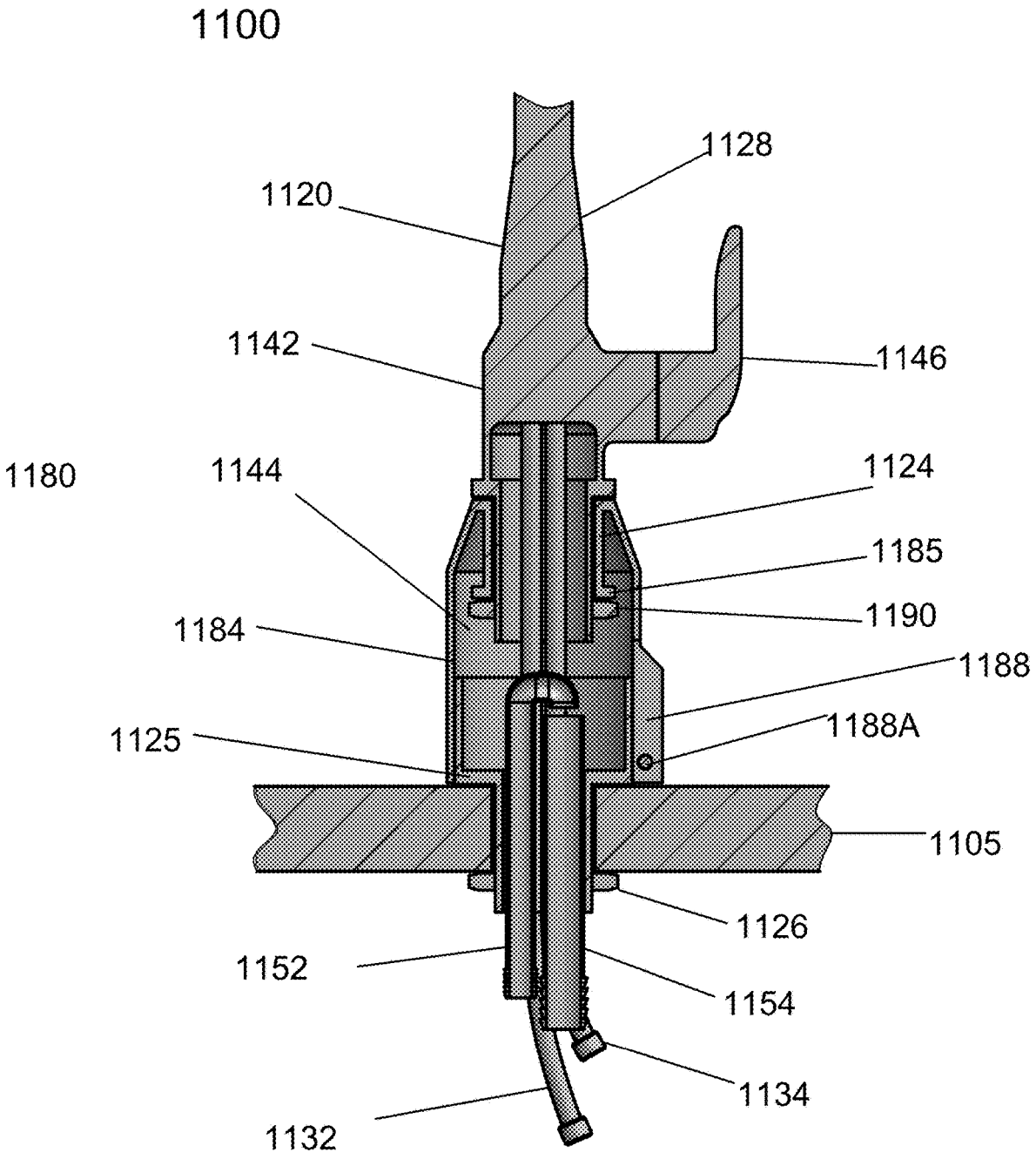
FIG. 12A is a side planar view of the embodiment of an integrated airgap faucet that includes a retrofit body illustrated in FIG. 12.

FIG. 12A is a side planar view of an embodiment of an integrated airgap faucet that includes a retrofit body 1180. Integrated airgap faucet 1100 faucet body 1120 projects through retrofit body 1180. Handle 1146 connects to the valve that is inside of valve body 1142. Faucet body 1120 is secured to flange 1185 on the top interior portion of retrofit body 1180. Retrofit body 1180 projects through countertop 1105 and is and is secured by retaining ring 1126. Appliance wastewater conduit 1152 is in fluid communication with the wastewater input from an appliance (not shown) which is part the airgap vent 1150. Hollow cavity 1144 includes axially symmetric portion 1184 structured and configured to contain integrated airgap vent 1150. Hollow cavity 1144 of retrofit body 1180 also includes interior flange 1185 that is contiguous with the end of fixture cavity conduit 1124. Interior flange 1185 extends away from the interior of fixture cavity conduit 1124. Finally, hollow cavity 1144 includes airgap conduit 1152 that is structured and configured to allow airgap vent 1150 to be inserted therethrough. Faucet body 1120 is secured to the interior flange 1185 by a faucet retaining nut 1190 that is threaded onto the pre-existing threads (not shown) of Faucet body 1120. Hollow cavity 1144, as shown, includes seating flange 1125. Seating flange 1125 is structured and configured to stabilize retrofit body 1180 when retrofit body 1180 is inserted into a hole in a sink or countertop. Seating flange 1125 may be connected to the axially symmetric portion 1184 with the compression provided by flanges 1188 in conjunction with set screws 1188A which compress the axially symmetric portion 1184 together with seating flange 1125 once installation of faucet body 1120 is complete. When seating flange 1125 is disconnected from axially symmetric portion 1184 by removal of set screws 1188A access to the faucet retaining nut 1190 may be obtained.

Figure 12B:
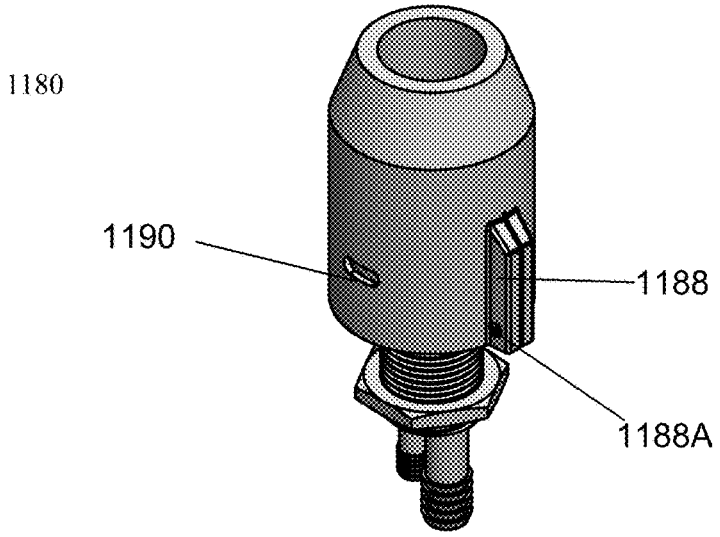
FIG. 12B is a perspective view of the embodiment of the retrofit body illustrated in FIG. 12.
Figure 12C:
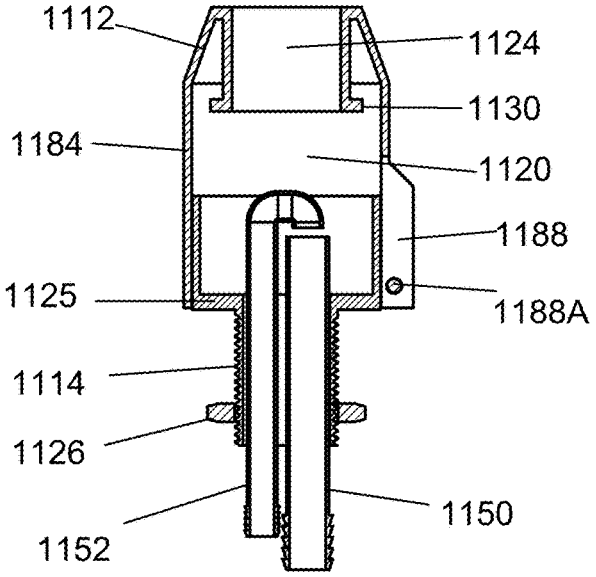
FIG. 12C is a side planar view illustration of a bisection of an embodiment of a retrofit body illustrated in FIG. 12B.
Figure 12D:
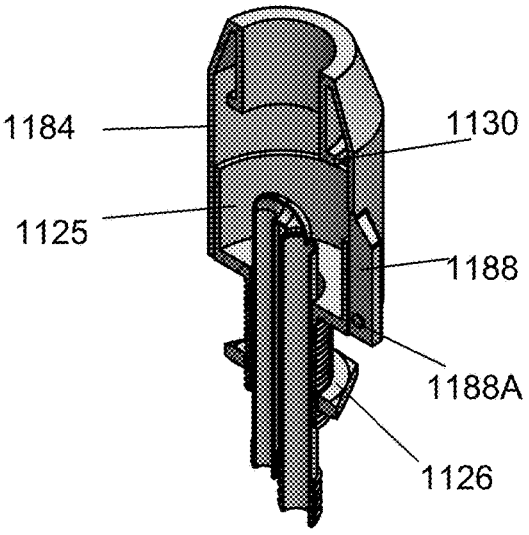
FIG. 12D is a perspective view of the bisection of the embodiment of the retrofit body illustrated in FIG. 12B.

FIGS. 12B-12D are illustrations of an embodiment of a retrofit body 1180 according to this disclosure. FIG. 12B is a perspective view of the embodiment of the outside of the retrofit body 1180. FIG. 12C is a side planar view illustration of a bisection of the embodiment of a retrofit body 1180. FIG. 12D is a perspective view of the bisection of the embodiment of the retrofit body 1180 illustrated in FIG. 12C. Retrofit body 1180 is shown as one continuous part that is arranged as follows. Retrofit body 1180 includes hollow cavity 1120 that is substantially cylindrical in shape. In this application substantially cylindrical refers to the arrangement in which axially symmetric portion 1184 of retrofit body 1180 completely surrounds hollow cavity 1120. The profile of a horizontal cross section of hollow cavity 1120 can be circular, or can have the shape of any regular polygon such as, for example, a square, hexagon, etc. It is also contemplated that the horizontal cross section of the hollow cavity can be somewhat irregular such as an oval or slightly rectangular. Hollow cavity 1120, shown as having a circular horizontal cross section, has a diameter. Hollow cavity 1120 also includes fixture cavity conduit 1124 at one end and airgap vent conduit at an opposing end. Hollow cavity 1120 includes axially symmetric portion 1184 structured and configured to contain integrated airgap vent 1150.

Hollow cavity 1120 also includes tapered portion 1112 that is contiguous with one end of the axially symmetric section 1184. Tapered portion 1112 reduces the diameter of hollow cavity 1120 and is in communication with fixture cavity conduit 1124. Fixture cavity conduit 1124 extends toward the inside of cavity 1120.

Hollow cavity 1120 of retrofit body 1180 also includes interior flange 1130 that is contiguous with the end of fixture cavity conduit 1124. Interior flange 1130 extends away from the interior of fixture cavity conduit 1124. Finally, hollow cavity 1120 includes airgap conduit 1126 that is structured and configured to allow airgap vent 1150 to be inserted therethrough.

The embodiment illustrated in FIGS. 12B-D also include threads 1114 on the exterior of airgap conduit 1126. Hollow cavity 1120, as shown, includes seating flange 1125. Seating flange 1125 is structured and configured to stabilize retrofit body 1180 when retrofit body 1180 is inserted into a hole in a sink or countertop. Seating flange 1125 may be connected to the axially symmetric portion 1184 with the compression provided by compression provided by flanges 1188 in conjunction with set screws 1188A which compress the seating flange 1125 and axially symmetric portion 1184 together once installation of faucet body 1120 is complete. Retrofit body 1180 can also include airgap vent 1150 that in FIGS. 12B-D is inserted through airgap conduit and into hollow cavity 1120. Retrofit body 1180 as shown in the accompanying illustrations include at least one retaining nut 1126 engaged with threads 1114 on the exterior wall of airgap conduit 1126. In some embodiments, axially symmetric portion 1184 of disclosed retrofit body 1180 can have pressure equalizing vent 1190 projecting through axially symmetric portion 1184 and into hollow cavity 1120.

Various modifications and alterations to this disclosure will become apparent to those skilled in the art without departing from the scope and spirit of this disclosure. It should be understood that this disclosure is not intended to be unduly limited by the illustrative embodiments set forth herein and that such embodiments are presented by way of example only with the scope of the disclosure intended to be limited only by the claims set forth herein as follows. All references cited in this disclosure are herein incorporated by reference in their entirety.

What is claimed is:

1. A retrofit body comprising:

a hollow cavity substantially cylindrical in shape having a diameter and having a fixture cavity conduit at one end and an airgap vent conduit at an opposing end, the hollow cavity comprising:

an axially symmetrical portion structured and configured to contain an airgap vent;

a tapered portion contiguous with one end of the axially symmetrical portion, wherein the tapered portion reduces a diameter of the hollow cavity and is in communication with the fixture cavity conduit, the fixture cavity conduit extending towards an inside of the hollow cavity;

an interior flange contiguous with an end of the fixture cavity conduit, the interior flange extending away from an interior of the fixture cavity conduit; and the airgap vent conduit opposite the fixture cavity conduit structured and configured to allow the airgap vent to be inserted therethrough.

2. A retrofit body according to claim 1, wherein an exterior of the airgap vent conduit comprises threads.

3. A retrofit body according to claim 2, wherein the retrofit body further comprises at least one retaining nut engaged with the threads on the exterior of the airgap vent conduit.

4. A retrofit body according to claim 1, further comprising a seating flange structured and configured to stabilize the retrofit body when the retrofit body is inserted into a hole in a sink or a countertop.

5. A retrofit body according to claim 4, wherein the seating flange is connected to the axially symmetrical portion via threading on an interior of the seating flange and an exterior of the axially symmetrical portion.

6. A retrofit body according to claim 4, wherein the seating flange is connected to the axially symmetrical portion with a means of compression.

7. A retrofit body according to claim 1, further comprising the airgap vent inserted through the airgap vent conduit and into the hollow cavity.

* * * * *